US005702858A

United States Patent [19]

Yuasa et al.

[11] Patent Number: 5,702,858

[45] Date of Patent: Dec. 30, 1997

[54] TONER

[75] Inventors: Yasuhito Yuasa; Noriaki Hirota; Akinori Toyoda; Hideki Tatematsu, all of Osaka, Japan

[73] Assignee: Matsushita Electric Industrial Co., Ltd., Osaka, Japan

[21] Appl. No.: 679,130

[22] Filed: Jul. 12, 1996

Related U.S. Application Data

[63] Continuation-in-part of Ser. No. 419,988, Apr. 11, 1995, Pat. No. 5,561,019.

[30] Foreign Application Priority Data

| | | | |
|---|---|---|---|
| Apr. 22, 1994 | [JP] | Japan | 6-084529 |
| May 13, 1994 | [JP] | Japan | 6-099622 |
| May 13, 1994 | [JP] | Japan | 6-099623 |
| May 18, 1994 | [JP] | Japan | 6-103726 |
| May 18, 1994 | [JP] | Japan | 6-103727 |
| Nov. 18, 1994 | [JP] | Japan | 6-284856 |

[51] Int. Cl.[6] ..... G03G 9/083; G03G 13/09

[52] U.S. Cl. ..... 430/106.6; 430/122; 430/126

[58] Field of Search ..... 430/106, 106.6, 430/109, 122, 137, 126

[56] References Cited

U.S. PATENT DOCUMENTS

| | | | |
|---|---|---|---|
| 5,215,845 | 6/1993 | Yuasa et al. . | |
| 5,215,849 | 6/1993 | Makuta et al. | 430/110 |
| 5,307,122 | 4/1994 | Ohno et al. . | |
| 5,364,720 | 11/1994 | Nakazawa et al. | 430/106.6 |
| 5,364,730 | 11/1994 | Kojima et al. | 430/137 |
| 5,370,961 | 12/1994 | Zaretsky et al. . | |
| 5,482,808 | 1/1996 | Kondo et al. | 430/110 |
| 5,561,019 | 10/1996 | Yuasa et al. | 430/106.6 |

FOREIGN PATENT DOCUMENTS

| | | |
|---|---|---|
| 0223594 | 5/1987 | European Pat. Off. . |
| 0395026 | 10/1990 | European Pat. Off. . |
| 0427275 | 5/1991 | European Pat. Off. . |
| 0488789 | 6/1992 | European Pat. Off. . |
| 0541113 | 5/1993 | European Pat. Off. . |
| 0581257 | 2/1994 | European Pat. Off. . |
| 3428433 | 2/1985 | Germany . |
| 60-32060 | 2/1985 | Japan . |
| 61-249059 | 11/1986 | Japan . |
| 1-250970 | 10/1989 | Japan . |
| 1-252982 | 10/1989 | Japan . |
| 2-212867 | 8/1990 | Japan . |
| 2-287459 | 11/1990 | Japan . |
| 4-162048 | 6/1992 | Japan . |

*Primary Examiner*—John Goodrow
*Attorney, Agent, or Firm*—Morrison & Foerster LLP

[57] ABSTRACT

Toner used for electrophotographic development includes additives such as inorganic fine particles, having a particular particle diameter and specific surface area, and hydrophobic silica having a particular specific surface area and surface treatment, so that the toner can provide images of high quality without generating photoconductor filming. The toner is applied to the electrophotographic method including the developing step of forming electrostatic latent images on a photoconductor containing a stationary magnet, magnetically attracting the toner to the surface of the photoconductor in a toner sump, and collecting toner at a non-image section by an electrode roller; the transferring step of transferring the toner to transfer paper; the cleaning step of removing residual toner left on the photoconductor in the transferring step; and the recycling step of recycling the residual toner. Toner used for an electrophotographic method using an intermediate transfer member includes additives such as inorganic fine particles, having a particular particle diameter and specific surface area, arid hydrophobic silica having a particular specific surface area and surface treatment, so that the toner can provide images of high quality and high transfer efficiency without generating photoconductor and intermediate transfer member filming.

52 Claims, 6 Drawing Sheets

TONER

This is a continuation-in-part of application Ser. No. 08/419,988, filed Apr. 11, 1995, U.S. Pat. No. 5,561,019 which is incorporated by reference herein in its entirety for all purposes.

FIELD OF THE INVENTION

The invention relates to a toner which can be used in copying machines, printers, facsimiles and the like.

BACKGROUND OF THE INVENTION

Conventional electrophotographic methods for developing electrostatic latent images include the cascade phenomenon method, the touch down method, and the jumping method, etc. The cascade developing method disclosed in U.S. Pat. No. 3,105,770 involves sprinkling developing powder directly on a photoconductor. The cascade developing method was the first electrophotographic method applied to copying machines for practical use. Also, U.S. Pat. No. 3,866,574 discloses a developing method of stirring up one component toner by applying a.c. bias to a developing roller. In this method, the a.c. bias is applied so as to activate the movement of the toner, so that the toner is stirred up at image areas and returned at non-image areas on the photoconductor.

A method which improved the technique of applying the a.c. bias is the jumping developing method disclosed in Published Examined (Kokoku) Japanese Patent Application No. Sho 63-42256. In this method, the toner is supported by a toner support member, and a doctor blade is provided on the toner support member for regulation of a rigid body or elastic body at a minute spacing to the support member. The toner is regulated into a thin layer by the doctor blade and transferred to a developing section, where the toner is deposited on the image areas of the photoconductor with the a.c. bias application. This method is different from the one disclosed in the above-mentioned U.S. Pat. No. 3,866,574 since the toner in the former method moves reciprocatingly between the image section and the non-image section.

Also, in a color copying machine, a photoconductor is charged through corona discharge using a corona charger and exposed to signal light as latent image of each color, and an electrostatic latent image is formed. Then the latent image is developed by first color toner, for example yellow toner.

Subsequently, the photoconductor is in contact with a transfer material charged oppositely from the charge of the yellow toner, and a yellow toner image formed on the photoconductor is transferred to the transfer material. Toner left on the photoconductor during transfer is cleaned and electrostatically removed. In this way, development and transfer of the first color toner is completed.

Subsequently, similar operation as that for the yellow toner is repeated for magenta toner, cyan toner, etc., and toner image of each color is superimposed on the transfer material to form a color image. These superimposed toner images are transferred to transfer paper charged oppositely with respect to toner, and fixed.

There are generally two color image forming methods, a transfer drum method in which toner image of each color is formed sequentially on a single photoconductor, a transfer material wrapped around a transfer drum is rotated and repeatedly faced with this photoconductor, and each color toner image formed on the photoconductor is sequentially superimposed on and transferred to the transfer material, and a serially superimposing method in which a plurality of image forming sections are arranged, respective image forming sections are passed past a transfer material conveyed by a belt to transfer each color toner image sequentially, and color images are superimposed each other.

An example of a device using the above-mentioned transfer drum method is a color image forming device disclosed in Published Unexamined (Kokai) Japanese Patent Application No. Hei 1-252982 which is incorporated by reference herein. FIG. 1 shows a schematic of the entire structure of this conventional example. Its structure and operation will be explained below.

In FIG. 1, 501 is a photoconductor, and a charging device 502, a developing section 503, a transfer drum 504, a cleaner 505 are provided to face this photoconductor. The developing section 503 comprises a Y developing device 506 for forming a yellow color toner image, a M developing device 507 for magenta color, a C developing device 508 for cyan color, and a Bk developing device 509 for black color. The entire group of the developing devices is rotated, and each developing device is faced with the photoconductor 501 in turn to be capable of developing. During operation, the transfer drum 504 and the photoconductor face each other and rotate respectively in the direction of an arrow at a fixed speed.

When image forming operation starts, the photoconductor 501 is rotated in the arrow direction, and its surface is charged uniformly by the charging device 502. Then, the surface of the photoconductor is exposed to laser beam 510 modulated by a signal for forming an image of a first color, yellow, and a latent image is formed. Next, this latent image is developed by the Y developing device 506 facing the photoconductor first, and a yellow toner image is formed. By the time the yellow toner image formed on the photoconductor is moved to a position facing the transfer drum 504, a sheet of paper as a transfer material fed from a paper feed section 511 is already wrapped around the transfer drum 504 with its leading edge held by a claw section 512, and timing is controlled so that the yellow toner image on the photoconductor encounters and faces a predetermined position of the paper.

After the yellow toner image on the photoconductor is transferred to the paper by the action of a transfer charging device 513, the surface of the photoconductor is cleaned by the cleaner 505 and prepared for next image formation. Subsequently, magenta, cyan, and black toner images are formed similarly. The developing section 503 is capable of developing when each developing device used according to color is faced with the photoconductor. The diameter of the transfer drum has an enough size that paper of maximum length can be wrapped around it and exchange of the developing device for each color image formation can be performed.

Exposure to the laser beam 510 for each color image formation is performed with such timing that as the photoconductor and the transfer drum are rotated, each color toner image on the photoconductor and already transferred toner image on the paper on the transfer drum are registered to face each other. In this way, four color toner images are transferred to and superimposed on the paper on the transfer drum 504, and a color image is formed on the paper. After all color toner images are transferred to the paper, the paper is peeled from the transfer drum 504 by a peeling claw 514, passed through a carrier section 515 to a fixing device 516 by which the toner images are fixed, and then discharged outside of the color image forming device.

On the other hand, Published Unexamined (Kokai) Japanese Patent Application No. Hei 1-250970, which is also incorporated herein, discloses a color image forming device using a serially transferring method. In this conventional example, four image forming stations are arranged which respectively include a photoconductor and a light scanning means for four color image formation. Paper carried by a belt is passed under respective photoconductors and color toner images are superimposed on the paper.

Furthermore, as another method of forming a color image by superimposing different color toner images on a transfer material, the method comprising steps of superimposing on an intermediate transfer material each color toner image formed sequentially on a photoconductor and finally transferring the toner images on the intermediate transfer material collectively to transfer paper is disclosed in Published Unexamined (Kokai) Japanese Patent Application No. Hei 2-212867 which is incorporated by reference.

As a fixing method used for permanently fixing transferred toner on coping paper, a heat roll method, a pressure roll method, a flash fusing method, methods using chemicals, and the like are known. Among them, a heat roll method in which toner is fused in contact with paper and fixed on the paper is general in view of energy efficiency, safety, and printing quality.

It is well known that toner used for electrostatic developing methods including the methods mentioned above generally consists of resin, a coloring component such as pigment and dye, and an additive such as plasticizer and a charge control agent. As a resin, natural or synthetic resin, or the combination of both is used.

The cascade developing method is poor in reproducing solid images. The method also requires an extremely large and complicated device. Moreover, the developing device disclosed in U.S. Pat. No. 3,866,574 requires high precision, and is complicated and costly. In the jumping developing method, a thin layer of the toner on a toner support member at a uniform thickness must always be formed. In addition, a previous image remains on the toner thin film, thus a residual image appears on an image in this method (sleeve ghost). There is also a problem in that the device used in this method is complicated and costly.

In order to solve these problems, an electrophotographic method disclosed in Published Unexamined (Kokai) Japanese Patent Application No. Hei 5-72890 was proposed. The device used in this method consists of a photoconductor containing a stationary magnet and an electrode roller having a magnet. The electrode roller faces the photoconductor with a predetermined gap in between. Thus, in this method, solid images are steadily reproduced and sleeve ghosts are not generated. Also, the device is further miniaturized and simplified, thus lowering the cost.

However, in order to improve the quality of images with this method, toner is required to be of high quality. In this method, since the doctor blade is not used, the toner is carried to a developing field between the photoconductor and the electrode roller without being controlled to a thin layer. Therefore, there is little space for the toner to be tribo-charged and to obtain tribo-charge amount, and the toner is required to have uniform high chargeable properties. Images become uneven and fog in non-image sections increases. This is because the tribo-charge becomes uneven within the toner, so the chargeable properties of the toner become uneven.

In order to increase the fluidity of toner, a method of adding silica, etc. as an additive is disclosed in Published Examined (Kokoku) Japanese Patent Application No. Sho 54-16219, and a method of using hydrophobic silica fine powder is disclosed in Published Unexamined (Kokai) Japanese Patent Applications No. Sho 46-5782, No. Sho 48-47345 and No. Sho 48-47346 both of which are incorporated by reference. For example, hydrophobic silica fine powder is prepared by reacting silica fine powder and an organic silicon compound such as dimethyl dichlorosilane, and replacing silanol groups on the surface of silica fine powder with organic groups. Although the fluidity of toner increases due to the additive, silica fine particles are likely to aggregate with each other. As a result, the suspended matter of silica increases, and a photoconductor will be scratched by the suspended matter. Residual films from the silica and toner are also generated on the photoconductor.

When using toner in which magnetic particles are contained as an internal additive, the particles are exposed after toner materials are pulverized. Thus, the toner will scratch a photoconductor, thus generating filming. With the filming on a photoconductor, the surface potential of the photoconductor is not likely to decline when a charged photoconductor is exposed to light. As a result, in reverse development, image defects such as the formation of white sections in a black image are found. White point noise is also generated since the suspended matter of silica adheres to a black image section. Thus, the addition of silica fine powder provides the above-noted additional problems.

In the electrophotographic method to which the magnetic toner of the invention is applied, the toner is first sprinkled over the entire surface of a photoconductor, and then developed. Therefore, compared with other conventional methods, toner is in contact with the photoconductor for a long time. As a result, toner filming is likely to generate.

In order to prevent such filming, a friction reducing material such as polyvinylidene fluoride powder is disclosed in Published Examined (Kokoku) Japanese Patent Applications No. Sho 48-8136, No. Sho 48-8141 and No. Sho 51-1130.

Furthermore, Published Unexamined (Kokai) Japanese Patent Application No. Sho 48-47345 discloses the addition of a friction reducing material and an abrasive material in toner. Even though the addition is effective for eliminating toner filming, paper dust, which adheres to a photoconductor surface due to repeated use, and low electrical resistance materials such as ozone products cannot be removed. The electrostatic latent image of the photoconductor thus is heavily damaged particularly in high temperature and humidity.

Published Unexamined (Kokai) Japanese Patent Applications No. Sho 60-32060 and No. Sho 59-219754 disclose the addition of titanate-based fine powder to toner as a second additive. The powder is mechanically pulverized, and the particle shape of the powder is irregular. Although the powder can be used to remove foreign matter on a photoconductor, protruding sections of the particles harm the photoconductor, thus distorting images. Moreover, in the electrophotographic method to which the toner of the invention is applied, toner is in contact with the entire surface of a photoconductor. Thus, when the titanate fine powder is simply added and copies with low black area ratios are taken, only the powder in the toner is consumed and used up in the long term, thus eliminating the ability of the toner to resist filming.

Also, in the method, a transferring roller is in contact with a photoconductor. Therefore, the abrasive material, friction-reducing material, etc. are transferred to the roller and are not supplied to a cleaning blade if the abrasive material, friction-reducing material, etc. are simply added to the toner. As a result, filming cannot be prevented.

Thus merely adding other abrasive materials such as alumina and titania to toner provides a negative effect on the chargeable properties of the toner. As a result, image density is reduced, and fog increases.

Environmental protection has also been an issue of great concern. In conventional copying machines, laser printers, laser plain paper facsimiles, etc., toner is developed on a photoconductor in the developing step, and the toner is then transferred to paper in a transferring step. Some of the toner remains on the photoconductor, and that toner is removed in a cleaning step. The cleaned toner, however, is residual toner. In conventional methods, particularly in the one-component developing method, the residual toner is not recycled.

A problem with recycling residual toner is that the fluidity of the toner declines due to the stress received in a developing field, thus fluctuating charge amount. The residual toner with reduced fluidity aggregates and clogs up a doctor blade. When the residual toner of a conventional toner is recycled and mixed with new toner in a developing device, the charging amount distribution of the toner becomes uneven, and wrong sign toner.

Also, in order to recycle the residual toner for development, the toner has to be useful for a long period. In particular, the ability of the toner to resist filming needs to be increased from the conventional level. Thus, improved dispersion of additives in the toner, reduced aggregation of the toner, and even adherence of the toner should be satisfied.

In an electrophotographic method of the present invention, a conductive elastic roller can be used. When a roller and conventional toner are used, letters and lines are transferred without the transfer of their internal image sections. Also, the toner is scattered around the letters and lines.

When conventional toner is transferred to transfer paper by a transfer roller, the roller is in contact with a photoconductor with predetermined stress. Compared with sections where there is no toner, a lot of toner is deposited at sections where the toner is concentrated and the stress increases. As a result, the toner aggregates due to high stress, and is not transferred to the transfer paper. Therefore, letters and lines are transferred without the transfer of internal image sections (hollow characters). The toner on a photoconductor is transferred to transfer paper by the relation among the charge potential of toner, the opposite charge potential of roller added from outside. Therefore, when the potential of the toner is low, the toner scatters on the empty space of paper around the letters and lines.

When a conventional toner is used, the toner is not recycled. Thus, important natural resources are not being effectively used, and the environment is harmed.

Also, an electrophotographic method of the present invention can include an intermediate transfer member.

In a transfer drum method, a transfer drum is used for registering and superimposing different color toner images. Each color toner image is registered each other for forming a color image by rotating this transfer drum at the same speed as that of a photoconductor, and controlling the timing of a tip of the images. However, in the above-mentioned structure, the transfer drum was required to be wrapped by paper, so that the diameter of the transfer drum was required to be larger than a certain diameter. Also, its structure was very complicated and high accuracy was required, so that the device was bulky and expensive. Furthermore, hard paper such as a postcard and cardboard could not be used since it could not be wrapped around the transfer drum.

On the other hand, in a serially transferring method, image forming positions corresponding to the number of colors were provided, and paper was passed there sequentially, so that a transfer drum was not required. However, in this method, a plurality of latent image forming means such as a laser optical system for forming latent images on a photoconductor were required corresponding to the number of colors, and the structure was very complicated and expensive. Furthermore, since a plurality of image forming positions were provided, relative misalignment of each color image forming section, eccentricity of the axis of rotation, difference of degree of parallelization between each section, etc. directly affected displacement of colors, and as a result, it was difficult to obtain high image quality stably. Particularly, this method had disadvantages in that performing accurate registration between each color latent image by the latent image forming means was required, and in that complicated structure was required in an image exposure system which was a latent image forming means as described in Published Unexamined (Kokai) Japanese Patent Application No. Hei 1-250970.

Furthermore, in Published Unexamined (Kokai) Japanese Patent Application No. Hei 2-212867, in order to form each color toner image on the same photoconductor, a plurality of developing devices were required to be arranged around a single photoconductor, so that the photoconductor became inevitably large. The photoconductor was also of belt form which was difficult to handle. Also, the maintenance of each color developing device and the photoconductor was difficult since matching of developing device properties with photoconductor properties was required when each ,developing device was exchanged for maintenance, and alignment of each developing device was required when the photoconductor was exchanged.

However, in the intermediate transfer method, a complicated optic system is not necessary, hard paper such as a postcard and cardboard can be used, and the method becomes flexible when an intermediate transfer belt is used, so that this method has an advantage in that it can attain a smaller device compared with the transfer drum method and the serially transferring method.

It is desirable that all toner is transferred during transfer, however, a part of toner is left on the photoconductor. Transfer efficiency is not 100%, generally about 75–90%. This toner left during transfer is scraped by a cleaning blade or the like in a cleaning step as a residual toner.

In a structure using an intermediate transfer member, toner is subjected to at least two transferring steps, in which the toner is transferred from a photoconductor to the intermediate transfer member and then from the intermediate transfer member to an acceptor paper, so that transfer efficiency of 85% with a common copying machine requiring one transferring step decreases to 72% with two transferring steps. Furthermore, transfer efficiency of 75% at one transferring step decreases to 56% with two transferring steps, which means about half of toner becomes residual toner. In this case, the cost of toner increases, and the capacity of a residual toner box should be larger, therefore a smaller device can not be attained. Decline of transfer efficiency is considered to be caused by fog and transfer without the transfer of a part of toner due to dispersion failure.

In the case of color development, since toner layers can become thick due to superimposing four color toner images on an intermediate transfer member, a difference in pressure between a thick toner layer part and a thin or no toner layer part occurs easily. Therefore, "hollow characters" effect in which a part of an image is not transferred to paper due to toner aggregation effect to become a hollow part is likely to occur. Also, in the case that material which easily detaches toner is used for the intermediate transfer member in order to ensure cleaning when acceptor paper is stuck, hollow characters occur frequently, significantly reducing image quality. Furthermore, edge effect is caused where characters, lines, etc. exist, and more toner is deposited there, causing aggregation of the toner due to pressure, and therefore remarkable hollow characters. This becomes more remarkable particularly under environment of high humidity and high temperature.

In addition, when filming is generated on the photoconductor at a level which is not significant with a common transfer method, contact of the intermediate transfer member with the photoconductor varies, causing a large decline of image quality.

SUMMARY OF THE INVENTION

It is an object of the invention to solve the above-noted conventional problems by providing a toner, which has high chargeable properties and fluidity and can provide high image density and image quality, and a developing method which further reduces the size, complexity and cost of a developing device and which recycles its toner.

It is another object of the invention to provide a toner which can prevent hollow characters (which are transferred without affecting the internal area) and scattered transfer in a low ozone treatment by using roller transfer.

It is also an object of the invention to provide a toner which can prevent photoconductor filming during long-term use.

Furthermore, it is an object of the invention to provide a toner which does not reduce the charge amount and fluidity of the toner and does not generate aggregating objects even if residual toner is recycled, thus recycling natural resources.

It is also an object of the invention to provide a toner which can prevent hollow characters and scattered transfer and attain high transfer efficiency by an electrophotographic method using an intermediate transfer member.

It is also an object of the invention to provide a toner which can prevent photoconductor and intermediate transfer member filming during long-term use.

In one aspect of the present invention, a toner comprises tones base particles comprising at least binder resin, and additives including inorganic fine particles of 0.05–4 μm volume-average particle diameter and 0.1–40 $m^2/g$ specific surface area, and negatively charged hydrophobic silica fine particles having 50–350 $m^2/g$ specific surface area that have been treated with silicone oil by a surface treatment, wherein the inorganic fine particles are prepared, e.g., by a hydrothermal method or an oxalate thermal decomposition method and preferably comprise at least one compound selected from the group consisting of $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$. The additives are added to the surface of the toner base particles.

The toner can preferably be used for an electrophotographic method comprising the steps of:

forming electrostatic latent images on a movable photoconductor containing a stationary magnet, magnetically attracting the toner to the surface of the photoconductor positioned in a toner slump, the toner comprising toner base particles comprising at least binder resin, and an additive comprising inorganic fine particles of 0.05–4 μm volume-average particle diameter and 0.1–40 $m^2/g$ specific surface area, and negatively charged hydrophobic silica fine particles having 50–350 $m^2/g$ specific surface area and treated with silicone oil by a surface treatment, holding the toner on the surface of the photoconductor, shifting the photoconductor so as to face a toner collecting electrode roller which has a magnet inside and is positioned at a predetermined position from the surface of the photoconductor, and leaving the toner at an image section of the photoconductor and collecting the toner at a non-image section by the toner collecting electrode roller to thereby develop an image;

transferring the toner from the photoconductor to transfer paper by electrostatic force; and removing residual toner left on the photoconductor in the transferring step to clean the photoconductor, wherein the inorganic fine particles are prepared by a hydrothermal method or an oxalate thermal decomposition method and preferably comprise at least one compound selected from the group consisting of $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

The toner can also be employed in an electrophotographic method that comprises the steps of:

forming electrostatic latent images on a movable photoconductor containing a stationary magnet, magnetically attracting the toner to the surface of the photoconductor positioned in a toner sump, the toner comprising toner base particles comprising at least binder resin, and an additive comprising inorganic fine particles of 0.05–4 μm volume-average particle diameter and 0.1–40 $m^2/g$ specific surface area, and negatively charged hydrophobic silica fine particles having 50–350 $m^2/g$ specific surface area and that were treated with silicone oil by a surface treatment, holding the toner on the surface of the photoconductor, shifting the photoconductor so as to face a toner collecting electrode roller which has a magnet inside and is positioned at a predetermined position from the surface of the photoconductor, and leaving the toner at an image section of the photoconductor and collecting the toner at a non-image section by the toner collecting electrode roller;

passing transfer paper between the photoconductor and a conductive elastic roller which is in contact with the photoconductor, and transferring the toner from the photoconductor to the paper by transfer bias voltage applied to the conductive elastic roller to transfer the toner; and removing residual toner left on the photoconductor in the transferring step to clean the photoconductor, wherein the inorganic fine particles are prepared by a hydrothermal method or an oxalate thermal decomposition method and preferably comprise at least one compound selected from the group consisting of $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

In another aspect of the invention, the toner can be used for an electrophotographic method comprising the steps of:

forming electrostatic latent images on a movable photoconductor containing a stationary magnet, magnetically attracting the toner to the surface of the photoconductor positioned in a toner sump, the toner comprising toner base particles comprising at least binder resin, and an additive comprising inorganic fine particles of 0.05–4 μm volume-average particle diameter and 0.1–40 $m^2/g$ specific surface area, and negatively charged hydrophobic silica fine particles having 50–350 $m^2/g$ specific surface area and that were treated with silicone oil by a surface treatment, holding the toner on the surface of the photoconductor, shifting the photoconductor so as to face a toner collecting electrode roller which has a magnet inside and is positioned at a predetermined position from the surface of the photoconductor, and leaving the toner at an image section of the photoconductor and collecting the toner at a non-image section by the toner collecting electrode roller to develop an image;

passing transfer paper between the photoconductor and a conductive elastic roller which is in contact with the photoconductor, and transferring the toner from the photoconductor to the paper by transfer bias voltage applied to the conductive elastic roller to transfer an image;

removing residual toner left on the photoconductor in the transferring step to clean the photoconductor; and collecting the residual toner removed in the cleaning step for recycling toner for re-use in the developing step, wherein the inorganic fine particles are prepared by a hydrothermal method and an oxalate thermal decomposition method and comprise at least one compound selected from the group consisting of $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

In yet another aspect of the invention, the toner can be used in an electrophotographic method comprising the steps of:

developing an electrostatic latent image formed on a photoconductor using toner, the toner comprising toner base particles comprising at least binder resin, and an additive comprising inorganic fine particles of 0.05–4 μm volume-average particle diameter and 0.1–40 $m^2/S$ specific surface area, and negatively charged hydrophobic silica fine particles having 50–350 $m^2/g$ specific surface area and that were treated with silicone oil by a surface treatment;

first transferring the toner to an endless intermediate transfer member which is in contact with the photoconductor;

forming a superimposed image of transferred toner by performing the first transferring step more than once; and secondly transferring the superimposed image of transferred toner which is formed on the intermediate transfer member to acceptor paper carried from a feed paper side, wherein the inorganic fine particles are prepared by a hydrothermal method and an oxalate thermal decomposition method and comprise at least one compound selected from the group consisting $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

It is preferable that the amount of the inorganic fine particles relative to 100 weight parts of the toner base particles is 0.1–5.0 weight parts, that the amount of the negative charge hydrophobic silica fine particles relative to 100 weight parts of the base particles is 0.1–5.0 weight parts, and that the inorganic fine particles have opposite sign chargeable properties with respect to the base particles and have from +3 μC/g to +30 μC/g charge amount with respect to the base particles.

DETAILED DESCRIPTION OF THE PREFERRED EMBODIMENTS OF THE INVENTION

Figure 1:
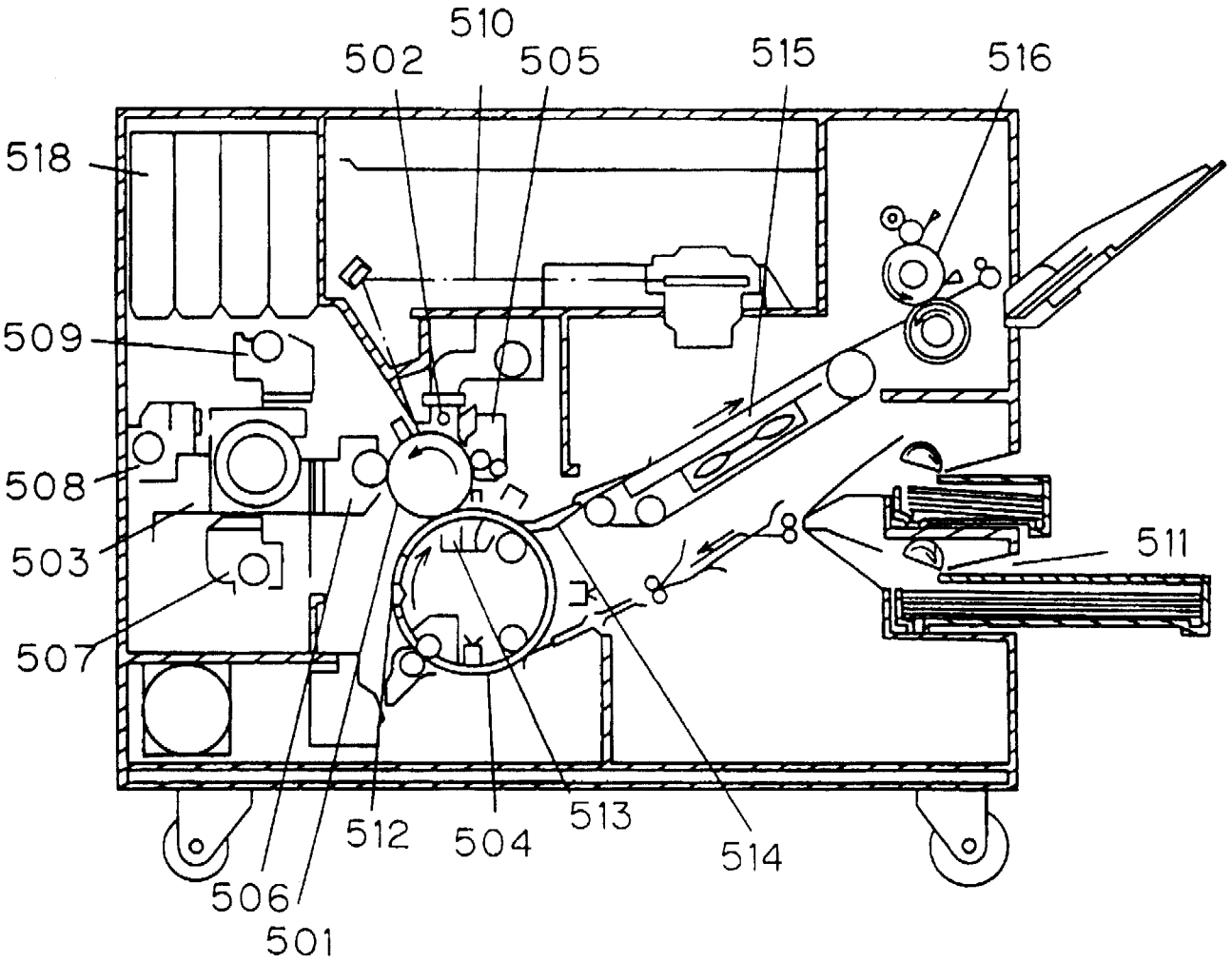
FIG. 1 (PRIOR ART)
FIG. 1 is a diagram of a conventional color electrophotographic device.

The electrophotographic method of the present invention can include the steps of sprinkling and adhering the toner by magnetic force to the photoconductor which has a fixed internal magnet and forms electrostatic latent images, transporting the toner to an electrode roller section, applying a.c. bias to the roller, and removing the toner at the non-image section of the photoconductor by electrostatic and magnetic force. In other words, the device used in this method can be miniaturized and improved in its performance, compared with those devices traditionally used in the cascade developing method, by depositing a magnet inside the photoconductor and applying alternating voltage to the electrode.

In the invention, development is almost completed when the toner is first sprinkled on the photoconductor. The electrode roller circulates the toner in a toner sump and collects the toner at the non-image section at the same time. In other words, the photoconductor holds and carries the toner from the toner sump to the developing field. The electrode roller and the photoconductor rotate in opposite directions at a section where the roller and the photoconductor face each other.

Since the developing step in the invention is simple, charging opportunities for the toner are scarce, and it is hard to provide toner with high chargeable properties. When the treatment of using the conductive elastic roller is added to the transferring step, the toner is required to be more fluid and have better chargeable properties than conventional toners in order to prevent hollow characters and scattering transfer.

Furthermore, the residual toner can be recycled in the invention. Since the electrode roller and the photoconductor rotate in opposite directions at a section where the roller and the photoconductor face each other, the toner can be immediately removed from a collecting section even if toner with reduced fluidity aggregates and is transported to the collecting section.

Images of high quality will not be stably obtained if the fluidity and chargeable properties of the toner in the developing step, the transferring step (using the conductive elastic roller), and the toner recycling step are higher than the conventional level. Formation of filming on the photoconductor can be prevented to a greater extent than at the conventional level.

Furthermore, an intermediate transfer member is used with the invention. Where an intermediate transfer member is employed, the fluidity of toner should be improved to improve transfer efficiency.

Also, the generation of toner composition filming on an intermediate transfer member using a belt or the like should be avoided. When filming is generated on the intermediate transfer member, a part of toner is not transferred, and accuracy in superimposing toner decreases, therefore images of high quality will not be obtained.

When the negatively charged hydrophobic silica fine particles surface treated with silicone oil are used as the additive, toner with high negative chargeable properties can be provided, thus improving the quality of images. In other words, since silanol groups, which are hydrophilic groups, are completely coated on the surfaces of the silica fine particles, the silica fine particles obtain high negative chargeable properties due to the siloxane groups present on the surfaces.

However, since the silica particles themselves have high chargeable properties and are prone to secondary aggregation, fluidity declines and white point noise and filming generate due to the aggregation of silica particles.

Thus, the negatively charged hydrophobic silica having 50–350 $m_2/g$ specific surface area and that is treated with a silicone oil such as shown in the following Formula 1 is preferably used and is mixed with the inorganic fine particles, so that aggregation of silica particles can be significantly controlled. The reason for this is not entirely understood, but it is thought that shearing force is added to silica particles when they are mixed with the inorganic particles, thus eliminating aggregation. Due to the elimination of aggregation, the fluidity of the toner increases and the chargeable properties of the toner improve. It is also found that the fluidity and chargeable properties of the toner are stable and images of high quality are provided, even if residual toner is recycled.

Formula 1

$$R^1-\underset{\underset{R^2}{|}}{\overset{\overset{R^2}{|}}{Si}}-O-(\underset{\underset{R^2}{|}}{\overset{\overset{R^2}{|}}{Si}}-O)_n-R^1$$

wherein $R^1$ and $R^2$ each represents hydrogen, an alkyl group, an aryl group or an alkoxy group, and n represents the degree of polymerization.

The polymerization degree (n) is preferably 10–100. When n is less than 10, it becomes more difficult to obtain high negative chargeable properties. On the other hand, if n is more than 100, surface treatment tends to become uneven.

When the specific surface area is less than 50 $m^2/g$, the fluidity of toner decreases. If the specific surface area is more than 350 $m^2/g$, aggregation becomes intense and is very difficult to prevent even if silica is mixed with the inorganic fine particles.

The generation of filming on the photoconductor and on the intermediate transfer member is difficult to prevent only by eliminating the aggregation of silica and providing uniform dispersion. Suspended silica particles cannot be controlled completely, so they adhere to the photoconductor. The particles are driven to the photoconductor by stress, thus generating toner filming. The stress is due to a cleaning blade and a transferring roller. Filming generated on the photoconductor is partly moved to the intermediate transfer member.

More specifically, since the particles adhere to the photoconductor. The laser beam is blocked or scattered, so that printed images will have hollow characters and lines or become blurry. Especially in the electrophotographic method to which the toner of the invention is applied, filming can be easily generated since toner adheres to the entire surface of the photoconductor in the developing step. Also, if the residual toner is recycled, latitude with respect to the filming becomes narrower.

However, by using inorganic fine particles as an additive, the photoconductor is not scratched, and foreign matter adhered to the photoconductor can be removed.

The inorganic fine particles separate from toner, adhere to the photoconductor by themselves, are supplied to a cleaning section without being transferred to a transfer material in the transferring step, and adhere to the cleaning blade. Since the inorganic fine particles adhere to the cleaning blade, the foreign matter adhered to the photoconductor can be removed.

When inorganic fine particles having 0.05–4 μm volume-average particle diameter and 0.1–40 $m^2/g$ specific surface area are used, the dispersion of the particles improves. The particles are also adhered evenly to the toner base particles and are effective against filming. If the volume-average particle diameter is less than 0.05 μm, the dispersion of the particles tends to decline, and the aggregated objects tend to increase, so that images become poor. Also, when the specific surface area is more than 40 $m^2/g$, the dispersion of the inorganic fine particles tends to decrease, thus increasing aggregated objects and providing poorer images. If the volume-average particle diameter of the particles is more than 4 μm, the particles tend to separate from the toner base particles, thus harming the photoconductor. There are too many large particles when the specific surface area is less than 0.1 $m^2/g$, so that the inorganic fine particles separate from the toner base particles, and the photoconductor is then harmed.

In an electrophotographic method of the present invention is applied, toner can be adhered to the entire surface of the photoconductor in the developing step, so that only inorganic fine particles are consumed when the particles separate from the toner and adhere to the photoconductor. If copies having a low black-area ratio are being continuously made, only inorganic fine particles are consumed, thus gradually reducing the effect against filming. In addition, there will be an excessive amount of inorganic fine particles in the residual toner, thus providing a negative effect on the chargeable properties and fluidity of recycled toner.

However, by adding inorganic fine particles of the invention, the particles are kept on the toner base particles at a desirable level, so that the consumption of inorganic fine particles can be controlled even if copies having a low black-area ratio are being continuously made. As a result, as long as there is toner, the inorganic fine particles are present. Even if the residual toner is recycled, resistance against filming is maintained.

Magnetic powder (magnetic particles) can be included in the toner of the invention if desired. The magnetic powder includes, for example, metallic powder such as iron, manganese, nickel and cobalt powder and ferrite such as iron, manganese, nickel, cobalt and zinc. The volume-average particle diameter of the powder is 0.05–1 μm, more preferably 0.1–0.6 μm. When the particle diameter is smaller than 0.05 μm, the particles aggregate and cannot be dispersed. The particles are exposed and harm the photoconductor when their diameter is larger than 1 μm. The added amount of the ponder is preferably 15–70% by weight. If the amount is less than 15%, the toner tends to scatter increasingly. When the amount is more than 70%, the charging volume of toner tends to decline, thus deteriorating the quality of images.

Inorganic fine particles are also contained in the toner of the invention. The particles can include $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, $V_2O_5$—$ZnO_2$ and the like. It is preferable that zirconate fine particles or titanate fine particles prepared by a hydrothermal method or an oxalate thermal decomposition method are used as the inorganic fine particles. For example, the titanate fine particles include $SrTiO_3$, $BaTiO_3$, $MgTiO_3$, $AlTiO_3$, $CaTiO_3$, $PbTiO_3$, $FeTiO_3$ , and the zirconate fine particles include $SrZrO_3$, $BaZrO_3$, $MgZrO_3$, $AlZrO_3$, $CaZrO_3$, $PbZrO_3$.

The method of preparing fine particles in a hydrothermal condition includes a hydrothermal oxidation method, a hydrothermal precipitation method, a hydrothermal composition method, a hydrothermal dispersion method, a hydrothermal crystallization method, a hydrothermal hydrolysis method, a hydrothermal agitate-mixing method, a hydrothermal mechano-chemical method and the like. Among these methods, the hydrothermal oxidation method, the hydrothermal precipitation method, the hydrothermal composition method, the hydrothermal dispersion method and the hydrothermal hydrolysis are preferred.

In the oxalate thermal decomposition method, a mixed solution A (at lower than 30° C.) of $TiCl_4$ (aq) and $BaCl_2.2H_2O$ is prepared when the particles are, for example, $BaTiO_3$ fine particles. Mixed solution A is added to an oxalic acid $(COOH)_2.2H_2O$ solution which is kept at 80°, thus providing $BaTiO(C_2O_4).4H_2O$. $BaTiO_3$ fine particles are obtained after heating $BaTiO(C_2O_4).4H_2O$ to higher than 600° C.

The fine particles prepared in the above-noted method rarely aggregate and have a narrow particle size distribution, good fluidity and spherical shapes. Thus, when the particles are added and mixed in the toner, they disperse well and adhere to the toner base particles uniformly. Also, since the shapes of the particles are spherical, the particles do not harm the photoconductor.

The amount of inorganic fine particles relative to the amount of the toner base particles (100 weight parts) is 0.1–5.0 weight parts. If the amount is less than 0.1 weight parts, the particles have little effect in resisting against filming. When the amount is more than 5.0 weight parts, the particles are likely to aggregate, thus harming the photoconductor.

The negatively charged hydrophobic silica fine particles treated with silicone oil by a surface treatment are contained in the toner of the invention. Silica fine particles prepared by the oxidation of a steam phase of silicate halide compound are preferable as the silica fine particles. For instance, the thermal decomposition oxidation reaction in the oxyhydrogen flame of silicon tetrachloride gas can be utilized. The following Formula 2 shows the reaction.

Formula 2

$$SiCl_4+2H_2+O_2 \rightarrow SiO_2+4HCl$$

The silicone oil used for the surface treatment is preferably polydimethyl silicone oil. Silicone oil including alkyl groups, silicone oil including fluorine groups, or the like can also be used.

A conventional method is applied as a surface treatment method, and conventional methods include a mixing method using a mixer such as a Henschel mixer and a method of injecting silicone oil.

The amount of silica relative to the amount of the toner base particles (100 weight parts) is preferably 0.1–5.0 weight parts. In order to prevent aggregation of toner itself, the silica should preferably be added at 0.1 weight parts or above. When the amount is more than 5.0 weight parts, suspended silica increases.

It is also preferable that the inorganic fine particles have wrong sign chargeable properties with respect to the toner base particles and have from +3 μC/g to +30 μC/g tribo-charge amount in a blow-off measurement method. Thus, the dispersion of inorganic fine particles improves, and the particles adhere to the toner base particles evenly and are used effectively against filming.

Since the inorganic fine particles have opposite chargeable properties, they rarely adhere to the transferring roller. The particles are also excellent for preventing filming because they are supplied to the cleaning blade section.

When the tribo-charge amount of the particles is less than +3 μC/g, the particles separate more from the toner base particles and are selectively consumed more. Also, as the amount of particles adhered to the transferring roller increases, the effect against filming declines. When the tribo-charge amount is more than +30 μC/g, the chargeable properties of the toner are negatively influenced and fog then generates.

The toner of the invention can be manufactured by a conventional method, and can be manufactured, for example, by a mixing process, a kneading process, a pulverizing process and an addition process and, if necessary, a classification process.

As the mixing process, a conventional method can be employed in which binder resin, and magnetic particles and internal additives such as an tribo-charge amount controlling agent, a detachant and pigment which are added if required are evenly dispersed by a mixer or the like having an agitating blade.

In the kneading process, the mixed material is heated, and the internal additives are dispersed in the binder resin by shearing force. Any conventional heating and kneading device can be used for the process. The heating and kneading device which heats and kneads by adding shearing force includes, for example, a three-roll type, a one-shaft screw type, a two-shaft screw type and an intensive mixer type. A chunk obtained from the process is pulverized by a cutter mill or the like, and is then processed to fine particles by a let mill or the like. If necessary, the fine particles can be further cut by a dispersion separator. As a result, a predetermined particle size distribution is obtained. The particles can also be pulverized and separated by a mechanical type pulverizer or classifier. For example, there is a method of pulverizing particles by introducing toner to a minute gap between a fixed stator and a roller. Conventional methods can be used for applied to the process.

Additives are added to the toner base particles which are prepared in the above-noted process. Any conventional method of addition can be applied to the process.

The binder resin used for the toner of the invention is a vinyl-based polymer which is polymerized or copolymerized vinyl-based monomer. Monomer styrene suitable for the binder resin, for example, includes styrene such as styrene, α-methylstyrene and P-chlorostyrene, and its substitution product; alkylester acrylics suitable for the binder resin includes acrylic acid, methyl acrylic, ethyl acrylic, butyl acrylic, dodecyl acrylic, octyl acrylic, isobutyl acrylic and hexyl acrylic; alkyl ester methacrylate includes monocarboxylic acid having a double bond such as methyl methacrylate, ethyl methacrylate, butyl methacrylate, octyl methacrylate, isobutyl methacrylate, dodecyl methacrylate and hexyl methacrylate, and its substitution product.

Conventional methods of manufacturing these copolymers can be employed. Such methods include, for example, bulk polymerization, solution polymerization, suspension polymerization and emulsion polymerization.

Copolymers used for the toner of the invention are a styrene type, and the styrene type copolymer is preferably included in the toner at 50–95% by weight. When the amount of styrene in the toner is less than 50% by weight, the melt characteristics of the toner decrease. Also, the fixing properties of the toner can become incomplete, and the crushability of the toner deteriorates.

Other conventional polymers or copolymers such as polyester resin, epoxy resin and polyurethane resin can also be used as the binder resin. The polyester resin is generally prepared by the polycondensation reaction of acid and alcohol. Polyester resins used for the toner of the invention, include, for example, fumaric acid as acid and bisphenol A as alcohol.

If required, one or more pigments or dyes can be added to the toner of the invention for the purpose of coloring, and controlling tribo-charge amount. The pigment or dye includes carbon black, black iron oxide, graphite, nigrosine, metallic complex of azo dye, copper phthalocyanine blue, Dupont oil red, aniline blue, benzine yellow, rose bengal or the mixture of these.

Furthermore, a detachant is also added to the toner of the invention, if desired. The detachant can be, for example, a polyolefin such as polypropylene and polyethylene.

In the developing method which can further reduce the size, complexity and cost of a developing device, images with high picture density and low fog are obtained by using toner which can maintain high fluidity and chargeable properties. In the transferring step using the conductive elastic roller, toner itself rarely aggregates even if the concentration of toner such as for letters and lines is transferred with a predetermined stress, thus providing clear complete images.

Even if residual toner is recycled, the fluidity and the charge amount of the toner do not decrease. Also, the generation of filming on the photoconductor is prevented.

Thus, a toner is provided which does not require the disposal of residual toner and prevents environmental contamination through recycling.

Furthermore, the generation of toner composition filming on the intermediate transfer member using a belt or the like can be avoided.

The invention will now be described by referring to the following examples and figures. The invention should not be limited to these examples.

EXAMPLE 1

The composition of the toner base particles of a toner used in examples 1–4 of the invention is shown in Table 1.

TABLE 1

| | | |
|---|---|---|
| Binder resin | styrene butyl acrylic copolymer resin (monomer ratio 82/18) melt viscosity at 135° C.: $1 \times 10^5$ (poise) melt viscosity at 145° C.: $2 \times 10^4$ (poise) | 100 wt. parts |
| Magnetic particles | magnetite (BL220 manufactured by Titan Kogyo Kabushiki Gaisha) | 56 wt. parts |
| * | Cr-metal complex azoic dye (S-34 manufactured by Orient Chemical Industries Co.) | 1.6 wt. parts |
| ** | polypropylene (TP-32 manufactured by Sanyo Chemical Industries, Ltd.) | 2.4 wt. parts |

*Charge controlling agent
**Detachant

The toner of this embodiment was manufactured as described below. Materials indicated in Table 1 were mixed by a Henschel mixer (FM-20B manufactured by Mitsui Miike Engineering Co.), then heated and kneaded by a two-shaft type extruder (PCM-30 (manufactured by Ikekai Co.), pulverized roughly to less than 2 mm by Rotoplex (manufactured by Alpine AKG.), and pulverized to fine particles by an IDS-2 type jet mill (manufactured by Nippon Neumatic MFG. Co.). The particles were then cut by a DS2-type dispersion separator (manufactured by Nippon Neumatic MFG. Co.). As a result, particles of 8 μm volume-average particle diameter were provided, and are called toner base particles. The toner of this embodiment is manufactured by mixing in additives with the base particles.

Table 2 shows additives used in the invention and comparative examples and their characteristics. The amount indicates weight parts relative to 100 weight parts of toner base particles. TA-1 is barium titanate fine particles prepared by a hydrothermal composition method, TA-2 is barium zirconate fine particles manufactured by an oxalate hydrothermal composition method, TB-1 is lead titanate and TB-2 is alumina fine particles.

TABLE 2

| | (1) | (2) | (3) | (4) | (5) |
|---|---|---|---|---|---|
| TA-1 | 0.7 μm | 2.6 $m^2/g$ | +9.5 μC/g | $BaTiO_3$ | * |
| TA-2 | 0.35 μm | 5.1 $m^2/g$ | +4.5 μC/g | $BaZrO_3$ | ** |
| TB-1 | 0.7 μm | 3.0 $m^2/g$ | +2.0 μC/g | $PbTiO_3$ | |
| TB-2 | 1.0 μm | 2.0 $m^2/g$ | +1.5 μC/g | $Al_2O_3$ | |

(1) volume-average particle diameter
(2) specific surface area
(3) Charge amount
(4) Chemical composition
(5) Method
*oxalate thermal decomposition method
**hydrothermal composition method The barium titanate fine particles were prepared by mixing hydrous titanate and barium hydroxide and reacting them at 200° C. in a hydrothermal condition. Then, they were washed, filtered, dried and pulverized. The mol ratio of Ba/Ti is 0.998.

The blow-off method was applied to measure the chargeable properties of the agents. In the method, 0.2 g of a sample was blown for 180 seconds with 0.2 $kgf/cm^2$ air stress, and was then measured. As measurement conditions, roughly crushed toner base particles were put through a mesh having pores of 100 μm diameter, and the additives were mixed with the base particles at 10% mixing density. Then, the agents mixed with the base particles were put into a 100 ml polyethylene bottle, and were agitated for ten minutes at 60 rpm.

The specific surface area is measured by a regular BET measurement method of nitrogen absorption, and a specific surface area measuring apparatus (Flow Sorb2 2300) manufactured by Shimadzu Corporation was used.

The volume-average particle diameter of inorganic fine particles was measured by a laser diffraction particle size measuring apparatus LS130 manufactured by Coulter Electronics, Inc. And the volume-average particle diameter of toner was measured by Coulter Counter TA-2 manufactured by Coulter Electronics, Inc.

The composition of the toner of this invention is shown in Table 3.

TABLE 3

| Toner | Toner base | Inorganic fine particles | Hydrophobic silica (*) | |
|---|---|---|---|---|
| Toner A1 | (Table 1) 100 wt. parts | TA-1 1.0 wt. part | R202(**) (***) (*******) | 1.0 wt. part 100 $m^2/g$ |
| Toner A2 | (Table 1) 100 wt. parts | TA-2 1.0 wt. part | TS-720 (****) (***) (*******) | 1.0 wt. part 100 $m^2/g$ |
| Toner B1 | (Table 1) 100 wt. parts | TB-1 1.0 wt. part | R974 (**) (*****) (*******) | 1.0 wt. part 170 $m^2/g$ |
| Toner B2 | (Table 1) 100 wt. parts | TB-2 1.0 wt. part | RX-200 (**) (******) (*******) | 1.0 wt. part 140 $m^2/g$ |

*Surface treatment agent
**Nippon Aerosil Co., Ltd.
***polydimethyl silicone oil
****CABOT CO.
*****dimethyl dichlorosilane
******hexamethylene disilazane
*******specific surface area The fluidity and the charge amount of each toner are shown in the following Table 4.

TABLE 4

| Toner | Apparent density | Charge amount |
|---|---|---|
| Toner A1 | 0.61 g/cc | −30.0 μC/g |
| Toner A2 | 0.50 g/cc | −32.0 μC/g |
| Toner B1 | 0.49 g/cc | −23.5 μC/g |
| Toner B2 | 0.48 g/cc | −22.2 μC/g |

The fluidity is indicated as the apparent density. A powder tester (PT-E type) manufactured by Hosokawa Micron Co., Ltd. was used for the measurement. The charge amount was measured by the blow-off method, and 0.2 g of a sample was blown for 180 seconds with 0.2 kgf/$cm^2$ air stress and was measured. The measurement of charge amount was the same as the measurement applied to the additives, except that a non-coat ferrite carrier was used instead of the toner base particles.

It was confirmed that toners A1 and A2 have high charge amount and fluidity.

EXAMPLE 2

Figure 2:
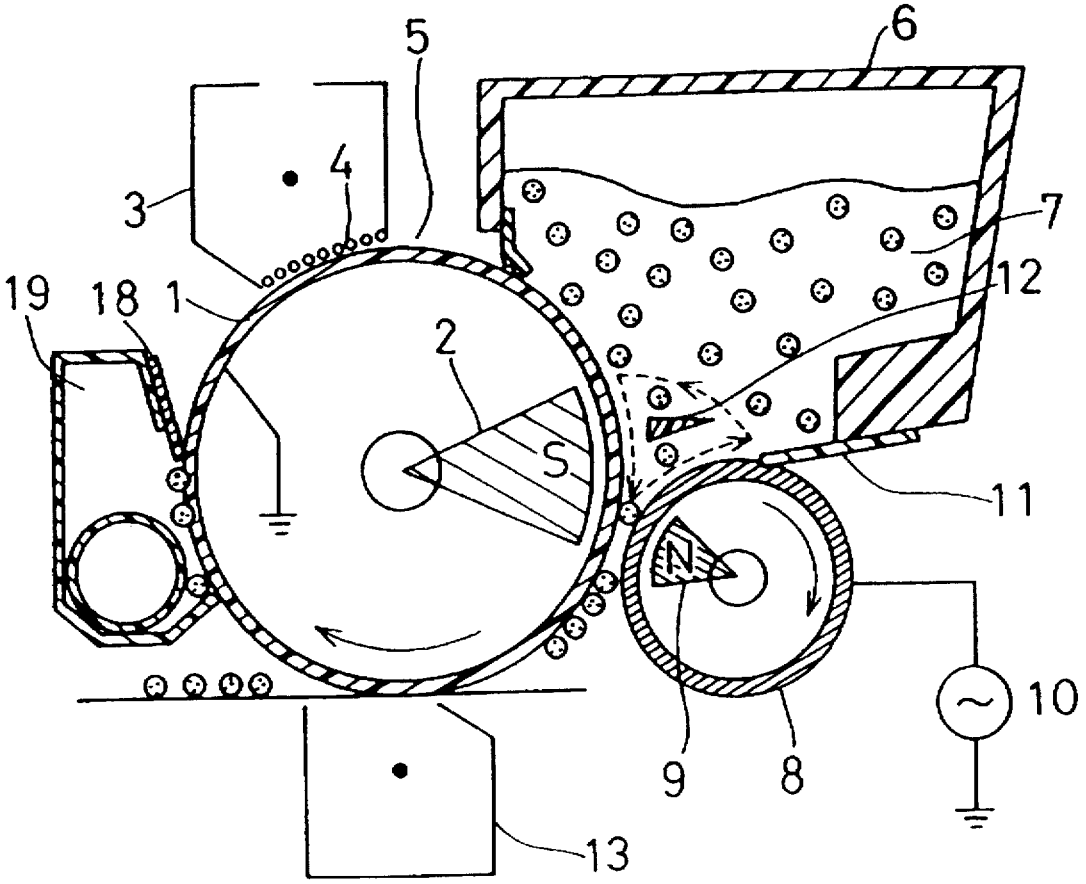
FIG. 2 is a cross-sectional view of a main section of an electrophotographic device in which toner of an embodiment of the invention is used.

The electrophotographic method shown in FIG. 2 is explained below. A one-component developing method is employed in this example. In the figure, 1 is a photoconductor (organic photoconductive drum) which disperses phthalocyanine in a polyester type binder resin; 2 is a magnet which is fixed along the same shaft of photoconductor 1; 3 is a corona charging device which charges the photoconductor negative; 4 is a grid electrode which controls the charge potential of the photoconductor; 5 is signal light (laser beam); 7 is a magnetic one-component toner; 6 is a toner sump for supplying toner 7 to the surface of photoconductor 1; 8 is a non-magnetic electrode roller deposited with a gap between itself and photoconductor 1; 9 is a magnet which is deposited inside electrode roller 8; 10 is an alternating high voltage power source applied to electrode roller 8; and 11 is a scraper made of polyester filming for scraping toner on the electrode roller. Residual toner at a non-image section is collected by electrode roller 8.

A damper 12 makes the flow of toner in the toner sump smooth and prevents toner from being pulverized by its own weight and being stuck between the photoconductor and the electrode roller.

A corona transfer charging device 13 transfers toner images on the photoconductor to paper.

Magnetic flux density on the surface of photoconductor 1 is 600 Gs. Magnetic force inside the electrode roller is increased so as to improve conveying properties. The magnetic pole angle (θ) of magnet 2 shown in the figure is 15°. The diameter of photoconductor 1 is 30 mm, and it rotates at 60 mm/s peripheral speed in an arrow direction shown in the figure. The diameter of electrode roller 8 is 16 mm, and it rotates at 40 mm/s peripheral speed in the opposite direction to the rotating direction of the photoconductor (indicated as an arrow in the figure) at a section where the roller and the drum face each other. The gap between photoconductor 1 and electrode roller 8 is 300 μm.

Photosensitive drum 1 was charged to −500V by corona charging device 3 (applied voltage −4.5 kV, and −500V at grid 4). Photoconductor 1 was exposed to laser beam 5, thus forming elestrostatic latent images. The exposure potential of the photoconductor was −90V. In toner sump 6, toner 7 was adhered to the surface of photoconductor 1 by the magnet. Then, photoconductor 1 was passed in front of electrode roller 8. When photoconductor 1 was passed through an uncharged region, 750 VO-p (1.5 kV peak to peak) alternating voltage (1 kHz in frequency) was applied to electrode roller 8 from alternating current high voltage power source 10. Then, the same alternating voltage (which was superimposed −350V dc voltage) was applied to electrode roller 8 from alternating current high voltage power source 10, when photoconductor 1 charged to −500V and formed with the electrostatic latent images was passed. As a result, toner that adhered to the charged sections of photoconductor 1 was collected by electrode roller 8, and negatively and positively inverted toner images in an image section only were left on photoconductor 1. Toner that adhered to electrode roller 8 was collected by scraper 11, and was returned to toner sump 6 for the next image formation. After the toner images on photoconductor 1 had been transferred to transfer paper by transfer charging device 13, they were fixed by heat with a fixing device (not shown in the figure), thus providing copied images.

Copying tests were directed by applying the electrophotographic method shown in FIG. 2 and using toner A1 shown in Example 1. Image density was measured by a reflection density measuring device (manufactured by Macbeth Co.), and the results were evaluated. According to the results, it was found that images were solid black and even with complete letters and without disordering horizontal lines and scattered toner. The images were high in quality, reproducing 16/mm image lines of 1.4 density. At the same time, images with 1.4 or higher image density were obtained, and there was also no fog in the non-image section.

A long-term copying test of 10,000 sheets was carried out. There was no decline in the fluidity of the toner after copying 10,000 sheets, and the toner kept a high tribo-charge amount. There was also no generation of filming on the photoconductor. The density of images was kept constant throughout the long-term copying. Table 5 shows the fluidity and the image density of toner at the beginning of and after the 10,000 sheet copying test.

TABLE 5

| | Apparent density (g/cm³) | | Image density | |
|---|---|---|---|---|
| Toner | * | ** | * | ** |
| Toner A1 | 0.61 | 0.60 | 1.42 | 1.41 |
| Toner A2 | 0.50 | 0.48 | 1.40 | 1.38 |
| Toner B1 | 0.49 | 0.40 | 1.10 | 0.90 |
| Toner B2 | 0.48 | 0.39 | 1.15 | 0.98 |

*beginning of the test
**after the test

EXAMPLE 3

Figure 3:
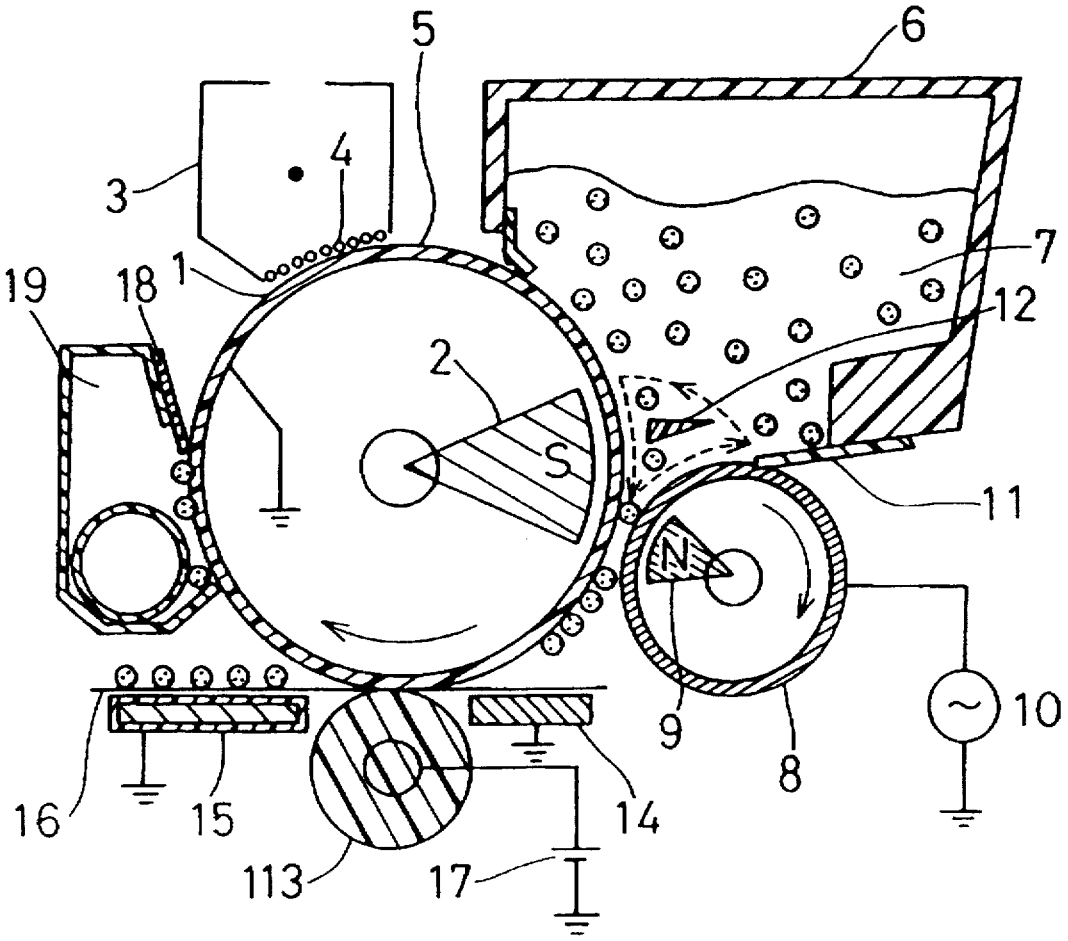
FIG. 3 is a cross-sectional view of a main section of an electrophotographic device in which toner of an embodiment of the invention is used.

An electrophotographic method of one embodiment is shown in FIG. 3. The corona transfer used in the method shown in FIG. 2 is replaced with roller transfer for the transferring step in the method shown in FIG. 3.

In the figure, 113 is a transfer roller for transferring toner images on the photoconductor to paper, and is in contact with photoconductor 1. The transfer roller is an elastic roller which is composed of a metallic shaft and a conductive elastic member around the shaft. The stress of a single transfer roller 113 (about 216 mm) against photoconductor 1 is 0–2,000 g, preferably 500–1,000 g. The stress was calculated from the product of displacement and spring factor of a spring used for pressing transfer roller 113 against photoconductor 1. The contacting width between the photoconductor and the roller is about 0.5–5 mm. The rubber hardness of transfer roller 113 is measured by the Asker C measurement method (using not a roller but a block) and is generally less than 80 degrees, more preferably 30–40 degrees. Conductive urethane elastomer having $10^7\Omega$ value of resistance (500V was applied to electrodes provided to the shaft and the surface) including foaming lithium salt was applied around the shaft of 6mm diameter. The outside diameter of transfer roller 113 was 16.4 mm, and the hardness was 40 degrees, measured by Askar C. Transfer roller 113 was in contact with photoconductor 1 by providing stress to the shaft of the roller with a metallic spring. The stress was about 1,000 g.

A chute 14 made of a conductive material introduces transfer paper to transfer roller 113; 15 is a carrier guide which is a conductive member coated with an insulator. Chute 14 and carrier guide 15 are grounded directly or through resistance. In the figure, 16 is transfer paper; 17 is a voltage-generating power source for applying voltage to transfer roller 113; 18 is a cleaning blade for removing residual toner left from the transferring step, and 19 is a cleaning box for holding the residual toner.

Even though an elastic urethane blade was used as the cleaning blade, the same results can be provided from a fur brush applied with bias or a conductive metallic roller. The rest of the characteristics of the example are the same as the ones in FIG. 2.

By using the electrophotographic device shown in FIG. 3, copying tests were directed with toner A1 of the invention. Image density was measured by a reflection densitometer manufactured by Macbeth Co., and the results were evaluated. According to the results, it was found that images were even and had solid black with complete letters, and there were no disordering horizontal lines and scattered toner. The images were high in quality, reproducing 16/mm image lines of 1.4 density. At the same time, images with 1.4 or higher image density were obtained, and there was also no fog in the non-image section.

The long-term copying test of 10,000 sheets was carried out. There was no decline in the fluidity of the toner after copying 10,000 sheets, and the toner kept a high quantity of tribo-charge amount. There was also no generation of filming on the photoconductor. The density of images was kept constant throughout the copying.

EXAMPLE 4

Figure 4:
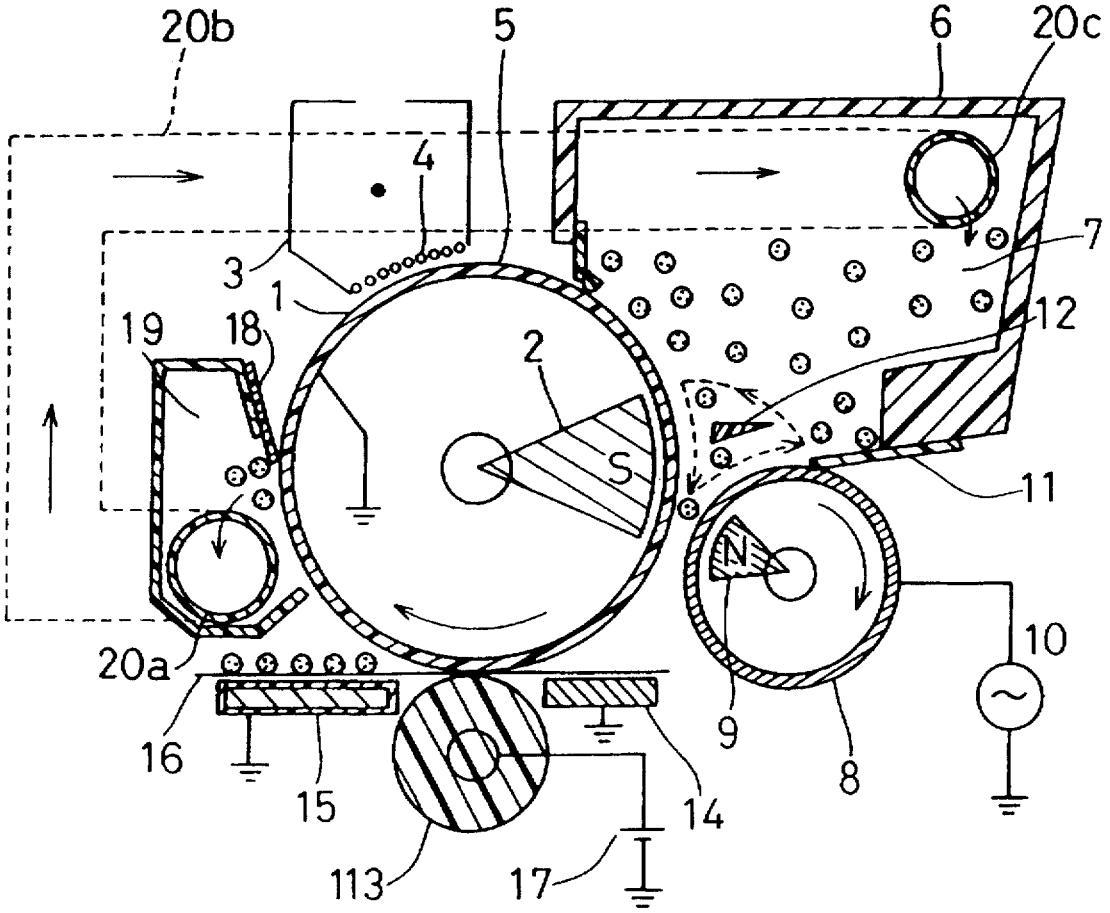
FIG. 4 is a cross-sectional view of a main section of an electrophotographic device in which toner of an embodiment of the invention is used.

An electrophotographic method of an embodiment is shown in FIG. 4. In FIG. 4, residual toner recycling is added to the electrophotographic method shown in FIG. 3. 20 is a transportation pipe which transports residual toner to a toner sump 6 of the developing device in the step of recycling the residual toner left from the transferring step. The method of transporting the residual toner includes any suitable method such as a method of using air, a method of transporting the toner in a spiral condition, a method of using magnetic force, a vibrating method, and other known methods. However, the method is not limited. Other characteristics of this example were the same as the characteristics shown in FIG. 3.

Copying tests were conducted by applying the electrophotographic device shown in FIG. 4 and using toner A1 of the invention. Image density was measured by a reflection density measuring device (manufactured by Macbeth Co.), and the results were evaluated. According to the results, it was found that images were even and solid black with complete letters and without disordering horizontal lines and scattered toner. The images were high in quality, reproducing 16/mm image lines of 1.4 density. At the same time, images with 1.4 or higher image density were obtained, and there was also no fog in the non-image section.

While the residual toner was recycled, the long-term copying test of 10,000 sheets was carried out. There was no decline in the fluidity of the toner after copying 10,000 sheets, and the toner maintained a high quantity of tribo-charge amount. There was also no generation of filming on the photoconductor. The density of images was kept constant throughout the copying, and the copied images had low fog. The toner was preferably recycled.

EXAMPLE 5

Figure 5:
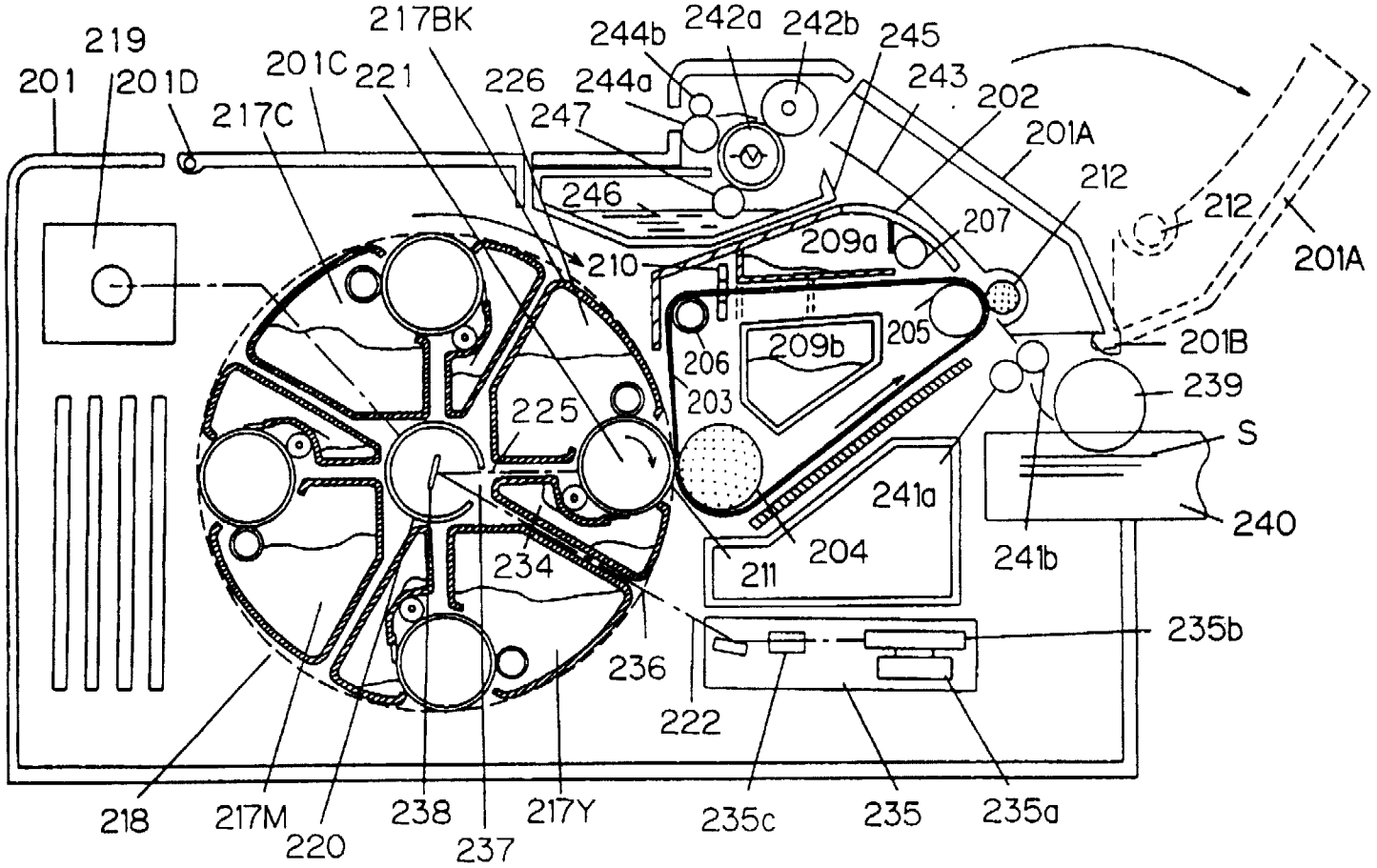
FIG. 5 is a cross-sectional view of a main section of an electrophotographic device in which toner of an embodiment of the invention is used.

A cross-sectional view of an electrophotographic device in which an electrophotographic method of an embodiment of the invention is used is shown in FIG. 5. Operation during color image formation will be explained below.

In FIG. 5, 201 is a housing of a color electrophotographic printer, and the right end side of the figure is front. 201A is a printer front plate, and the front plate can be freely lowered and opened as shown by a dotted line as well as lifted and closed as shown by a solid line around a hinge shaft 201B. The installation and removal of an intermediate transfer belt unit 202 inside the printer and also the inspection and maintenance of the printer when, for example, paper is stuck inside the printer is performed by lowering and opening the front plate 201A to leave the inside of the printer open. The intermediate transfer belt unit 202 is designed so that the installation and removal of the unit is performed perpendicular to the axial direction of the rotation of a photoconductor.

Figure 6:
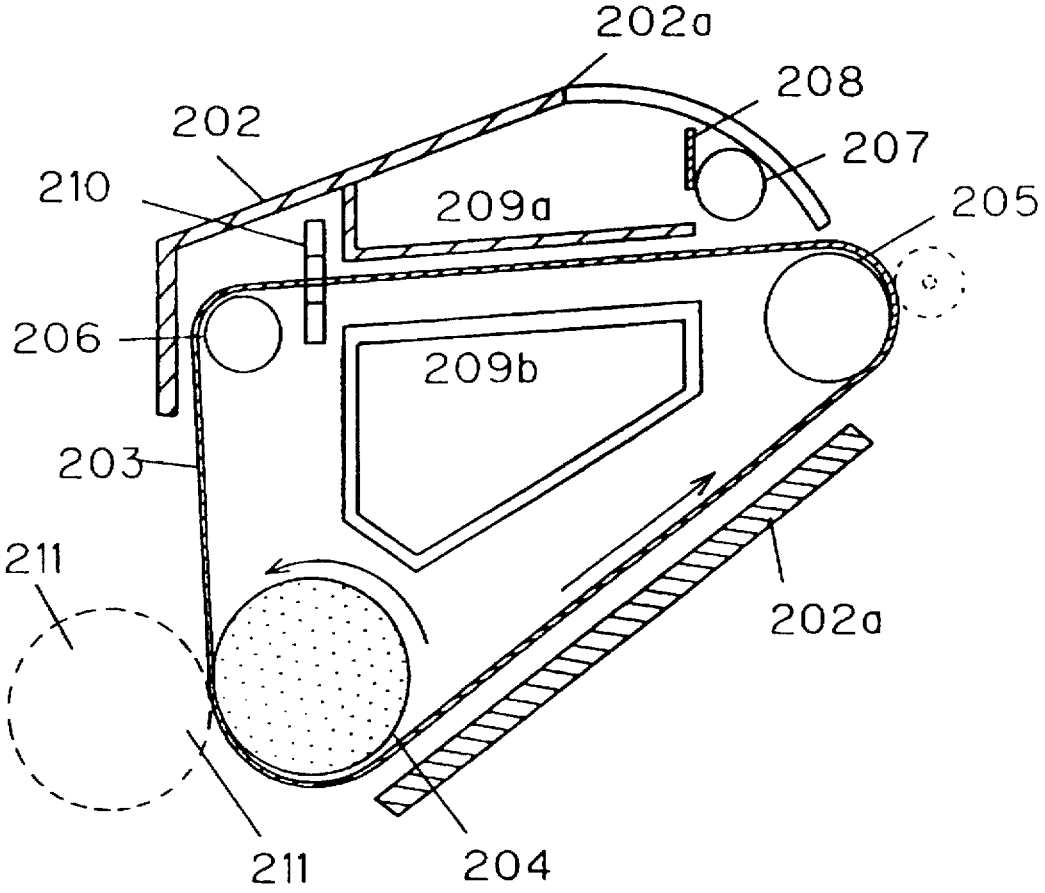
FIG. 6 is a diagram of an intermediate transfer belt unit shown in the embodiment of the invention.

The structure of the intermediate transfer belt unit 202 is shown in FIG. 6. The intermediate transfer belt unit 202 comprises in a unit housing 202*a*, a transfer belt 203, a first transfer roller 204 made of a conductive elastic body, a second transfer roller 205 made of an aluminum roller, a tension roller 206 which controls the tension of the transfer belt, a belt cleaner roller 207 which cleans toner left on the transfer belt, a scraper 208 which scrapes the toner collected on the cleaner roller 207, residual toner reservoirs 209*a* and 209*b* which reserve the collected toner, and a position detector 210 which detects a position of the transfer belt. This intermediate transfer belt unit 202 can be freely installed in and removed from a predetermined housing section inside the printer housing 201 by lowering and opening the printer front plate 201A in FIG. 5.

The intermediate transfer belt 203 is used by kneading conductive filler in insulating resin and then forming the kneaded resin into film by an extruder. In this embodiment, film in which 5 parts of conductive carbon (for example, Ketjen black) was added to 95 parts of polycarbonate resin (for example, Iupilon Z300 manufactured by Mitsubishi Gas Chemical Co., Inc.) as insulating resin and made to form film was used. The surface of the film was coated with fluorocarbon resin. The thickness of the film was about 350 μm, and resistance was about $10^7$–$10^8\Omega\cdot$cm.

This transfer belt is wrapped around the first transfer roller 204, the second transfer roller 205, and the tension roller 206 which are made up of endless belt shaped film with urethane base having thickness of 100 μm around which urethane foam treated to have resistance of $10^7\Omega\cdot$cm is formed, and the transfer belt is movable in the direction of an arrow. Here, the peripheral length of the transfer belt is determined to be 360 mm, which length is the length of longitudinal direction of A4 paper of a maximum paper size (298 mm) plus length slightly longer than half of the peripheral length of a photoconductor drum (diameter of 30 mm) which will be described below (62 mm).

When the intermediate transfer belt 202 is installed in the printer body, the first transfer roller 204 is pressed with force of about 1.0 kg against a photoconductor 211 (shown in FIG. 6) through the intermediate transfer belt 203, and the second transfer roller 205 is pressed against a third roller 212 (shown in FIG. 6) which has the same structure as that of the above-mentioned first transfer roller 204 through the intermediate transfer belt 203. This third transfer roller 212 is driven rotatable by the intermediate transfer belt 203.

The cleaner roller 207 is a roller in a belt cleaner section which cleans the intermediate transfer belt 203. This is configured as such that a.c. voltage which electrostatically attracts toner is applied to a metallic roller. Also, this cleaner roller 205 may be a rubber blade, or a conductive fur brush with voltage applied.

Again, referring to FIG. 5, in the center of the printer, four fan-shaped image forming units 217Bk, 217Y, 217M and 217C for each color of black, cyan, magenta, and yellow constitute a group of image forming units 218 and is arranged in a circle as shown in the figure. Each image forming unit can be freely installed in and removed from a predetermined position of the group of image forming units 218 by opening a printer upper plate 201C in FIG. 5 around a hinge shaft 201D. When the image forming units 217 are installed properly inside the printer, mechanical driving system and electric circuit system on both image forming units side and printer side are coupled by a mutual coupling member (not shown) to be integrated mechanically and electrically.

The image forming units 217Bk, 217C, 217M and 217Y arranged in a circle are supported by a supporting means (not shown), driven by a moving motor 219 which is a moving means, and are rotatable around a cylinder-shaped shaft 220 which is fixed and non-rotatable. Each image forming unit can be positioned at an image forming position 221 facing the second transfer roller 204 which supports the above-mentioned intermediate transfer belt 203 sequentially by rotating. The image forming position 221 is also a position exposed to signal light 222.

Each image forming unit comprises the same structure members except a developer contained in, so, in order to simplify this description, only the image forming unit for black 217Bk will be described in detail. Also, for each unit, like numerals indicates like parts, and when structure for each color is required to be distinguished, letters indicating each color is added to numerals.

In development, the method shown in the example 2 was used. A two-component developer and Cu—Zn—$Fe_2O_3$ coated with silicone resin as a carrier was used.

Again, referring to FIG. 5, 235 is a laser beam scanner section provided in a lower part within the printer housing 201, and it comprises semiconductor laser, a scanner motor 235*a*, a polygonal mirror 235*b*, a lens system 235*c*, etc. Laser signal light of picture elements 222 corresponding to a time series electric signal of picture elements of image information from the scanner section 235 passes through an optical path window 236 arranged between the image forming units 217Bk and 217Y in FIG. 5, enters a fixed mirror 238 inside the shaft 220 through a window 237 opened in a part of the shaft 220, is reflected, enters the image forming unit 217Bk substantially horizontally from an exposure window 225 in the image forming unit 217Bk at the image forming position, passes through a path between a developer reservoir 226 and a cleaner 234 provided respectively in an upper part and a lower part within the image forming unit, and enters an exposure section on the left side of the photoconductor drum 211, and then the photoconductor drum is scanned and exposed to the light in the axial direction.

Here, the optical path from the optical path window 236 to the mirror 238 uses space between the adjacent image forming units 217Bk and 217Y, so there is little useless space in the group of image forming units 218. Also, the mirror 238 is provided in the center section of the group of image forming units 218, so that it can be made up of a fixed single mirror, which is a simple structure in which registration, etc. can be easily performed.

212 is a third transfer roller provided inside the printer front plate 201A and above a feed roller 239, and in a nip section where the intermediate transfer belt 203 and the third transfer roller 212 are pressed each other, a paper carrier path is formed so that paper is fed from the paper feed roller 239 provided under the printer front plate 201A.

240 is a paper feed cassette provided projecting outwardly under the printer front plate 201A, and a plurality of paper S can be set in the cassette at the same time. 241*a* and 241*b* are paper carrier timing rollers, 242*a* and 242*b* are a pair of fixing rollers provided in an upper part of and inside the printer, 243 is a paper guide plate provided between the third transfer roller 212 and the pair of fixing rollers 242*a* and 242*b*, 244*a* and 244*b* are a pair of paper discharge rollers provided on the paper exit side of the pair of fixing roller 242a and 242b, 245 is a fixing oil reservoir which reserves silicone oil 246 to be fed to the fixing roller 242a, and 247 is an oil feed roller which applies the silicone oil 246 to the fixing roller 242a. The above is description of the main structure of the electrophotographic device of this invention.

In an electrophotographic device of this example, each image forming unit and the intermediate transfer belt unit is provided with a residual toner reservoir. Using toner of this invention, transfer efficiency is high and few residual toner is generated, so that capacity of the reservoir can be made very small.

First, the group of image forming units 218 is positioned as shown in FIG. 5, and the black image forming unit 217Bk is at the image forming position 221 as shown. Then, the photoconductor 211 is faced with and in contact with the first transfer roller 204 through the intermediate transfer belt 203.

In an image forming step, black signal light enters the image forming unit 217Bk from a laser exposure device 235, and image formation using black toner is performed. Then, the speed of image formation by the image forming unit 217Bk and the moving speed of the intermediate transfer belt 203 is set to be the same speed, and by image formation and by the action of the first transfer roller 204, a black toner image is transferred to the intermediate transfer belt 203. Then, +1 kV d.c. voltage is applied to the first transfer roller. Immediately after transfer of the entire black toner image is completed, the image forming units 217Bk, 217C, 217M and 217Y are driven as the group of image forming units 218 by the moving motor 219 to be rotated in an arrow direction in FIG. 5, and stopped just at 90 degree rotation where the image forming unit 217C reaches the image forming position 221. During this operation, since the toner sump 226 and the cleaner 234 except the photoconductor of the image forming unit are positioned inside a tip of the rotation arc of the photoconductor 211, the intermediate transfer belt 203 can not be in contact with the image forming unit.

After the image forming unit 217C reaches the image forming position 221, the laser exposure device 235 sends signal light to the image forming unit 217C by a cyan signal as mentioned above, and formation and transfer of a cyan toner image is performed. By this time, the intermediate transfer belt 203 is rotated once, and writing timing of the cyan signal light is controlled so that a cyan toner image is registered on the black toner image transferred before. During this operation, the third transfer roller 212 and the cleaner roller 207 is slightly apart from the intermediate transfer belt 203 so as not to disorder the toner images on the transfer belt.

The same operation as mentioned above was performed for magenta and yellow, and on the intermediate transfer belt 203, four color toner images were registered and superimposed to form a color image. After transfer of the last yellow toner image, the four color toner images were transferred collectively to paper fed with timing controlled from the paper feed cassette 240 by the action of the third transfer roller 212. Then, the second transfer roller 205 was grounded, and +1.5 kV d.c. voltage was applied to the third transfer roller 212. The toner images transferred to the paper was fixed by the pair of fixing rollers 242a and 242b. The paper was then discharged outside of the device through the pair of discharge rollers 244a and 244b. Residual toner left from the transferring step on the intermediate transfer belt 203 was cleaned by the action of the cleaner roller 207 and prepared for next image formation.

Operation during monochromatic mode will be described below. During monochromatic mode, first, a predetermined color image forming unit was moved to the image forming position. Then, predetermined color image formation and transfer to the intermediate transfer belt 203 was performed as mentioned above. After the transfer, transfer to paper fed from the paper feed cassette 240 was performed by the third transfer roller 212, and then fixing was performed.

In the above-mentioned embodiments, while the specific structure was used as a structure of an image forming unit, with an image forming unit using other conventional developing method, the essence and action effect of this invention does not change.

Examples of yellow coloring agent for toner are yellow pigment of benzidine, phorone-yellow, insoluble azo pigment of acetoacetanilide, monoazo die, etc.

Examples of magenta color agent are 2,9-dimethylquinacridone, insoluble azo pigment of naphthol, anthraquinone die, etc.

The composition of color toner used in this embodiment is shown in Table 6.

TABLE 6

| | | |
|---|---|---|
| Binder resin | styrene butyl acrylic copolymer resin softening point 128° C. | 100 wt. parts |
| * | polyester resin with acid value of 20 mgKOH/g | 20 wt. parts |
| **black | carbon black (#44 manufactured by Mitsubishi Chemical Corp.) | 6 wt. parts |
| yellow | yellow pigment of benzidine | 5 wt. parts |
| magenta | insoluble azo pigment of naphthol | 6 wt. parts |
| cyan | copper phthalocyanine pigment | 5 wt. parts |
| Detachant | polypropylene (TP32 manufactured by Sanyo Chemical Industries, Ltd.) | 4 wt. parts |
| | polyethylene (LEL400PEX manufactured by Sanyo Chemical Industries, Ltd.) | 4 wt. parts |
| Additive | hydrophobic silica (R202 manufactured by Nippon Aerosil Co., Ltd.) | 1 wt. part *** |
| | inorganic fine particles TA-1 | 1 wt. part *** |

*Charge controlling resin
**Coloring agent
***relative to 100 wt. parts of toner base particles 5 weight parts of yellow pigment of benzidine as yellow coloring agent, 6 weight parts of insoluble azo pigment of naphthol as magenta coloring agent, and 5 weight parts of copper phthalocyanine pigment as cyan coloring agent were added. 20 weight parts of polyester resin with acid value of 20 mgKOH/g was added for controlling tribo-charging amount. An acid value of 5–40 mgKOH/g is preferable. The amount is preferably 5–45 weight parts relative to 100 weight parts of binder resin.

The manufacture and evaluation of toner was performed similarly as in the example 1.

The charge amount of each toner was from −15 to −18 μC/g. Also, the charge amount of inorganic fine particles TA-1 relative to each toner base particles was 7.3–9.2 μC/g. Apparent density was 0.35–0.36 g/cm$^3$.

A copying test was performed by using the electrophotographic device shown in FIG. 5. As a result, images were solid black and even with complete letters and without disordering horizontal lines and scattered toner. The images were high in quality, reproducing 16/mm image lines of 1.4 density. At the same time, images with 1.4 or higher image density were obtained, and there was no fog in the non-image section.

Also, in a long-term copying test of 10000 sheets, the fluidity and image density of toner varied little, showing stable properties. Also during transfer, hollow characters were practically at a non-significant level, and transfer efficiency was 90%. The generation of toner filming on the photoconductor and the intermediate transfer belt was practically at a non-significant level.

Comparative Example 1

The same composition and process as in Example 1 were conducted so as to prepare toner B1, except that different additives from the ones in Example 1 were used.

As the additives, lead titanate fine particles and hydrophobic silica treated with dimethyl dichlorosilane were used.

Copying tests were directed with toner B1 by applying the electrophotographic method shown in Example 1.

Image density was measured by a reflection densitometer (manufactured by Macbeth Co.). As a result, it was found that images had low image density and a lot of fog.

In the long-term copying test, toner filming was found after 2,000 copies were made.

Comparative Example 2

The same composition and process as in Example 2 were directed so as to prepare toner B1, except that different additives from the ones in Example 1 were used.

As the addition agents, hydrophobic silica treated with hexamethylene disilazane and alumina fine powder were used.

Image density was measured by a reflection densitometer (manufactured by Macbeth Co.). As a result, it was found that images had low image density and a lot of fog.

In the long-term copying test, toner filming was found after 1,000 copies were made.

Comparative Example 3

The same toner as the one shown in Example 2 was prepared, except that the amount of added magnetic powder was 10% by weight in this example. The toner was heavily scattered and was not good for practical use.

Comparative Example 4

The same toner as the one shown in Example 2 was prepared, except that the amount of added magnetic powder was 80% by weight in this example. The toner had a low charge amount, and images had a lot of fog, so that the toner was not good for practical use.

Comparative Example 5

The same toner as the one shown in Example 2 was prepared, except that the amount of added silica was 0.05% by weight in this example. The toner had poor fluidity, and was not good for practical purpose.

Comparative Example 6

The same toner as the one shown in Example 2 was prepared, except that the amount of added silica was 6 weight parts in this example. The silica aggregated intensively, and a lot of white points adhered to a solid black image section, so that the toner was not good for practical use.

Comparative Example 7

The same toner as the one shown in Example 2 was prepared, except that the amount of added barium titanate fine particles was 0.05 weight parts in this example.

In the long-term copying test, toner filming was found after 1,000 copies were made. Practical images were not obtained.

Comparative Example 8

The same toner as the one shown in Example 2 was prepared, except that the amount of added barium titanate fine particles was 6 weight parts in this example. The barium titanate fine particles aggregated intensively, and the photoconductor was harmed. In other words, the toner was not good for practical use.

The various U.S. and foreign patents and published foreign patent applications set forth in this specification are hereby incorporated by reference in their entirety for all purposes.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A toner comprising toner base particles comprising a binder resin, and an additive comprising inorganic fine particles of 0.05–4 μm volume-average particle diameter and 0.1–40 $m^2$ /g specific surface area, and negatively charged hydrophobic silica fine particles having 50–350 $m^2$/g specific surface area and surface treated with a silicone oil, wherein the inorganic fine particles are prepared by a hydrothermal method or an oxalate thermal decomposition method and comprise at least one compound selected from the group consisting $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

2. The toner as in claim 1, wherein the inorganic fine particles are prepared by a hydrothermal method selected from the group consisting of a hydrothermal oxidation method, a hydrothermal precipitation method, a hydrothermal composition method, a hydrothermal dispersion method, a hydrothermal crystallization method, a hydrothermal hydrolysis method, a hydrothermal agitate-mixing method, and a hydrothermal mechano-chemical method.

3. The toner as in claim 1, wherein the inorganic fine particles are titanate fine particles prepared by a hydrothermal method or zirconate fine particles prepared by a hydrothermal method.

4. The toner as in claim 1, wherein the inorganic fine particles are titanate fine particles prepared by an oxalate thermal decomposition method or zirconate fine particles prepared by an oxalate thermal decomposition method.

5. The toner as in claim 1, wherein the inorganic fine particles are present in an amount of 0.1–5.0 weight parts relative to 100 weight parts of the toner base particles.

6. The toner as in claim 1, wherein the negatively charged hydrophobic silica fine particles are present in an amount of 0.1–5.0 weight parts relative to 100 weight parts of the toner base particles.

7. The toner as in claim 1, wherein the inorganic fine particles have oppositely chargeable properties with respect to the toner base particles, and have from +3 μC/g to +30 μC/g charge amount with respect to said toner base particles.

8. The toner as in claim 1, further comprising at least one magnetic component.

9. The toner as in claim 1, further comprising at least one pigment.

10. An electrophotographic method which comprises:

forming electrostatic latent images on a movable photoconductor containing a stationary magnet, magnetically attracting a toner to a surface of said photoconductor positioned in a toner sump, said toner comprising a binder resin, and an additive comprising inorganic fine particles of 0.05–4 μm volume-average particle diameter and 0.1–40 $m^2/g$ specific surface area, and negatively charged hydrophobic silica fine particles having 50–350 $m^2/g$ specific surface area and surface treated with a silicone oil, holding said toner on the surface of said photoconductor, shifting said photoconductor so as to face a toner collecting electrode roller which has an internal magnet and is positioned at a predetermined position from the surface of said photoconductor, and leaving said toner at an image section of said photoconductor and collecting said toner at a non-image section of said photoconductor by said toner collecting electrode roller to develop an image;

transferring said toner from said photoconductor to transfer paper by electrostatic force; and removing residual toner left on said photoconductor from said transferring step to clean the photoconductor, wherein the inorganic fine particles are prepared by a hydrothermal method or an oxalate thermal decomposition method and comprise at least one compound selected from the group consisting $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

11. The electrophotographic method as in claim 10, wherein the inorganic fine particles are prepared by a hydrothermal method selected from the group consisting of a hydrothermal oxidation method, a hydrothermal precipitation method, a hydrothermal composition method, a hydrothermal dispersion method, a hydrothermal crystallization method, a hydrothermal hydrolysis method, a hydrothermal agitate-mixing method, and a hydrothermal mechano-chemical method.

12. The electrophotographic method as in claim 10, wherein the inorganic fine particles are titanate fine particles prepared by a hydrothermal method or zirconate fine particles prepared by a hydrothermal method.

13. The electrophotographic method as in claim 10, wherein the inorganic fine particles are titanate fine particles prepared by an oxalate thermal decomposition method or zirconate fine particles prepared by an oxalate thermal decomposition method.

14. The electrophotographic method as in claim 10, wherein the inorganic fine particles are present in an amount of 0.1–5.0 weight parts relative to 100 weight parts of the toner base particles.

15. The electrophotographic method as in claim 10, wherein the negatively charged hydrophobic silica fine particles are present in an amount of 0.1–5.0 weight parts relative to 100 weight parts of the toner base particles.

16. The electrophotographic method as in claim 10, wherein the inorganic fine particles have oppositely chargeable properties with respect to the toner base particles, and have from +3 μC/g to +30 μC/g charge amount with respect to said toner base particles.

17. The electrophotographic method as in claim 10, wherein the toner further comprises at least one magnetic component.

18. The electrophotographic method as in claim 10, wherein the toner further comprises at least one pigment.

19. An electrophotographic method which comprises:

forming electrostatic latent images on a movable photoconductor containing a stationary magnet, magnetically attracting a toner to a surface of said photoconductor positioned in a toner sump, said toner comprising a binder resin, and an additive comprising inorganic fine particles of 0.05–4 μm volume-average particle diameter and 0.1–40 $m^2/g$ specific surface area, and negatively charged hydrophobic silica fine particles having 50–350 $m^2/g$ specific surface area and surface treated with a silicone oil, holding said toner on the surface of said photoconductor, shifting said photoconductor so as to face a toner collecting electrode roller which has an internal magnet and is positioned at a predetermined position from the surface of said photoconductor, and leaving said toner at an image section of said photoconductor and collecting said toner at a non-image section of said photoconductor by said toner collecting electrode roller to develop an image;

passing transfer paper between said photoconductor and a conductive elastic roller which is in contact with said photoconductor, and transferring said toner from said photoconductor to said transfer paper by transfer bias voltage applied to said conductive elastic roller; and subsequently removing residual toner left on said photoconductor in said transferring step to clean the photoconductor, wherein the inorganic fine particles are prepared by a hydrothermal method or an oxalate thermal decomposition method and comprise at least one compound selected from the group consisting of $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

20. The electrophotographic method as in claim 19, wherein the inorganic fine particles are prepared by a hydrothermal method selected from the group consisting of a hydrothermal oxidation method, a hydrothermal precipitation method, a hydrothermal composition method, a hydrothermal dispersion method, a hydrothermal crystallization method, a hydrothermal hydrolysis method, a hydrothermal agitate-mixing method, and a hydrothermal mechano-chemical method.

21. The electrophotographic method as in claim 19, wherein the inorganic fine particles are titanate fine particles prepared by a hydrothermal method or zirconate fine particles prepared by a hydrothermal method.

22. The electrophotographic method as in claim 19, wherein the inorganic fine particles are titanate fine particles prepared by an oxalate thermal decomposition method or zirconate fine particles prepared by an oxalate thermal decomposition method.

23. The electrophotographic method as in claim 19, wherein the inorganic fine particles are present in an amount of 0.1–5.0 weight parts relative to 100 weight parts of the toner base particles.

24. The electrophotographic method as in claim 19, wherein the negatively charged hydrophobic silica fine particles are present in an amount of 0.1–5.0 weight parts relative to 100 weight parts of the toner base particles.

25. The electrophotographic method as in claim 19, wherein the inorganic fine particles have oppositely chargeable properties with respect to the toner base particles, and have from +3 μC/g to +30 μC/g charge amount with respect to said toner base particles.

26. The electrophotographic method as in claim 19, wherein the conductive elastic roller used in the transferring step comprises a urethane foaming material, to which a conductive additive is added, as an elastic member.

27. The electrophotographic method as in claim 26, wherein the conductive additive is lithium salt.

28. The electrophotographic method as in claim 19, wherein the toner further comprises at least one magnetic component.

29. The electrophotographic method as in claim 19, wherein the toner further comprises at least one pigment.

30. The electrophotographic method which comprises:

forming electrostatic latent images on a movable photoconductor containing a stationary magnet, magnetically attracting a toner to a surface of said photoconductor positioned in a toner sump, said toner comprising a binder resin, and an additive comprising inorganic fine particles of 0.05–4 μm volume-average particle diameter and 0.1–40 $m^2/g$ specific surface area, and negatively charged hydrophobic silica fine particles having 50–350 $m^2/g$ specific surface area and surface treated with a silicone oil, holding said toner on the surface of said photoconductor, shifting said photoconductor so as to face a toner collecting electrode roller which has an internal magnet and is positioned at a predetermined position from the surface of said photoconductor, and leaving said toner at an image section of said photoconductor and collecting said toner at a non-image section of said photoconductor by said toner collecting electrode roller to develop an image;

passing transfer paper between said photoconductor and a conductive elastic roller which is in contact with said photoconductor, and transferring said toner from said photoconductor to said transfer paper by transfer bias voltage applied to said conductive elastic roller;

removing residual toner left on said photoconductor in said transferring step to clean the photoconductor; and recycling said residual toner in said developing step, wherein the inorganic fine particles are prepared by a hydrothermal method or an oxalate thermal decomposition method and comprise at least one compound selected from the group consisting $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

31. The electrophotographic method as in claim 30, wherein the inorganic fine particles are prepared by a hydrothermal method selected from the group consisting of a hydrothermal oxidation method, a hydrothermal precipitation method, a hydrothermal composition method, a hydrothermal dispersion method, a hydrothermal crystallization method, a hydrothermal hydrolysis method, a hydrothermal agitate-mixing method, and a hydrothermal mechano-chemical method.

32. The electrophotographic method as in claim 30, wherein the inorganic fine particles are titanate fine particles prepared by a hydrothermal method or zirconate fine particles prepared by a hydrothermal method.

33. The electrophotographic method as in claim 30, wherein the inorganic fine particles are titanate fine particles prepared by an oxalate thermal decomposition method or zirconate fine particles prepared by an oxalate thermal decomposition method.

34. The electrophotographic method as in claim 30, wherein the inorganic fine particles are present in an amount of 0.1–5.0 weight parts relative to 100 weight parts of the toner base particles.

35. The electrophotographic method as in claim 30, wherein the negatively charged hydrophobic silica fine particles are present in an amount of 0.1–5.0 weight parts relative to 100 weight parts of the toner base particles.

36. The electrophotographic method as in claim 30, wherein the inorganic fine particles have oppositely chargeable properties with respect to the toner base particles, and have from +3 μC/g to +30 μC/g charge amount with respect to said toner base particles.

37. The electrophotographic method as in claim 30, wherein the conductive elastic roller used in the transferring step comprises a urethane foaming material, to which a conductive additive is added, as an elastic member.

38. The electrophotographic method as in claim 37, wherein the conductive additive is lithium salt.

39. The electrophotographic method as in claim 30, wherein the cleaning is carried out with an elastic urethane blade.

40. The electrophotographic method as in claim 30, wherein the cleaning is carried out with a bias-applied fur brush.

41. The electrophotographic method as in claim 30, wherein the cleaning is carried out with a bias-applied conductive metallic roller.

42. The electrophotographic method as in claim 30, wherein the toner further comprises at least one magnetic component.

43. The electrophotographic method as in claim 30, wherein the toner further comprises at least one pigment.

44. An electrophotographic method which comprises:

developing an electrostatic latent image formed on a photoconductor using toner, the toner comprising toner base particles comprising a binder resin, and an additive comprising inorganic fine particles of 0.05–4 μm volume-average particle diameter and 0.1–40 $m^2/g$ specific surface area and negatively charged hydrophobic silica fine particles having 50–350 $m^2/g$ specific surface area and surface treated with a silicone oil;

first transferring the toner to an endless intermediate transfer member which is in contact with the photoconductor;

forming a superimposed image of transferred toner by performing the first transfer step more than once; and secondly transferring the superimposed image of transferred toner which is formed on the intermediate transfer member to acceptor paper carried from a feed paper side, wherein the inorganic fine particles are prepared by a hydrothermal method or an oxalate thermal decomposition method and comprise at least one compound selected from the group consisting of $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, and $V_2O_5$—$ZnO_2$.

45. The electrophotographic method as in claim 44, wherein the inorganic fine particles are prepared by a hydrothermal method selected from the group consisting of a hydrothermal oxidation method, a hydrothermal precipitation method, a hydrothermal composition method, a hydrothermal dispersion method, a hydrothermal crystallization method, a hydrothermal hydrolysis method, a hydrothermal agitate-mixing method, and a hydrothermal mechano-chemical method.

46. The electrophotographic method as in claim 44, wherein the inorganic fine particles are titanate fine particles prepared by a hydrothermal method or zirconate fine particles prepared by a hydrothermal method.

47. The electrophotographic method as in claim 44, wherein the inorganic fine particles are titanate fine particles prepared by an oxalate thermal decomposition method or zirconate fine particles prepared by an oxalate thermal decomposition method.

48. The electrophotographic method as in claim 44, wherein the inorganic fine particles are present in an amount of 0.1–5.0 weight parts relative to 100 weight parts of the toner base particles.

49. The electrophotographic method as in claim 44, wherein the negatively charged hydrophobic silica fine particles are present in an amount of 0.1–5.0 weight parts relative to 100 weight parts of the toner base particles.

50. The electrophotographic method as in claim 44, wherein the inorganic fine particles have oppositely chargeable properties with respect to the toner base particles, and have from +3 μC/g to +30 μC/g charge amount with respect to said toner base particles.

51. The electrophotographic method as in claim 44, wherein the toner further comprises at least one magnetic component.

52. The electrophotographic method as in claim 44, wherein the toner further comprises at least one pigment.

* * * * *